US008615174B2

(12) United States Patent
Koizumi et al.

(10) Patent No.: US 8,615,174 B2
(45) Date of Patent: Dec. 24, 2013

(54) IMAGE FORMING APPARATUS CAPABLE OF OPTIMALLY CONTROLLING TONER CONCENTRATION OF DEVELOPER

(75) Inventors: Eichi Koizumi, Kanagawa (JP); Makoto Komatsu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 180 days.

(21) Appl. No.: 13/192,043

(22) Filed: Jul. 27, 2011

(65) Prior Publication Data

US 2012/0027434 A1 Feb. 2, 2012

(30) Foreign Application Priority Data

Jul. 29, 2010 (JP) ..... 2010-170720

(51) Int. Cl.
*G03G 15/08* (2006.01)

(52) U.S. Cl.
USPC ..... 399/27; 399/30

(58) Field of Classification Search
None
See application file for complete search history.

(56) References Cited

U.S. PATENT DOCUMENTS

| | | | | |
|---|---|---|---|---|
| 5,784,669 | A * | 7/1998 | Miura et al. | 399/58 |
| 2007/0098449 | A1* | 5/2007 | Kadota et al. | 399/254 |
| 2008/0273885 | A1 | 11/2008 | Koizumi et al. | |
| 2008/0285986 | A1* | 11/2008 | Wada et al. | 399/27 |
| 2009/0322020 | A1 | 12/2009 | Iwata et al. | |
| 2010/0086320 | A1 | 4/2010 | Koizumi et al. | |
| 2010/0086322 | A1 | 4/2010 | Koizumi et al. | |
| 2010/0119264 | A1 | 5/2010 | Yamaguchi et al. | |
| 2011/0064478 | A1 | 3/2011 | Yamaguchi et al. | |

FOREIGN PATENT DOCUMENTS

| | | | | |
|---|---|---|---|---|
| JP | 2001-166583 A | * | 6/2001 | G03G 15/08 |
| JP | 2008-299315 | | 12/2008 | |
| JP | 2010-91786 | | 4/2010 | |
| JP | 2011-99985 | | 5/2011 | |
| JP | 2011-107315 | | 6/2011 | |

* cited by examiner

*Primary Examiner* — Clayton E Laballe
*Assistant Examiner* — Jas Sanghera
(74) *Attorney, Agent, or Firm* — Oblon, Spivak, McClelland, Maier & Neustadt, L.L.P.

(57) ABSTRACT

An image forming apparatus includes a latent image carrier; an image information obtaining unit; a latent image forming unit; a developer carrier; a developing device to develop the latent image by adhering toner onto the latent image carried on a latent image carrier; a toner replenishing device to replenish toner to the developing device; and a controller to adjust a toner replenishment amount by controlling drive of the toner replenishing device based on the image information. When the drive of the developing device is stopped, information relating to unreplenished portion of the toner replenishment amount excluding the already replenished amount from the toner replenishment amount based on the image information is stored in a nonvolatile memory, and the drive of the toner replenishing device is controlled using the stored information relating to the unreplenished portion of the toner replenishment amount when the drive of the developing device is resumed.

17 Claims, 22 Drawing Sheets

IMAGE FORMING APPARATUS CAPABLE OF OPTIMALLY CONTROLLING TONER CONCENTRATION OF DEVELOPER

CROSS-REFERENCE TO RELATED APPLICATIONS

The present application claims priority from Japanese patent application number 2010-170720, filed on Jul. 29, 2010, the entire contents of which are incorporated by reference herein.

BACKGROUND OF THE INVENTION

1. Field of the Invention

The present invention relates to an image forming apparatus such as a copier, printer, facsimile machine, or the like, and in particular relates to an image forming apparatus using a developer and capable of optimally controlling toner concentration of the developer.

2. Description of the Related Art

In image forming apparatuses such as printers, copiers, or facsimile machines, a developing device as disclosed in JP-2008-299315-A is known.

Recently, for the purpose of saving energy, the apparatus is frequently turned off in a relatively short time after the image formation has been completed. In addition, developer should not be performed after the completion of image formation in order to prevent degradation of the developer inside a developing device. Therefore, the drive of the developing device is frequently stopped immediately after image formation. In such a case, however, if the time until the drive of the developing device is stopped is too short, there may be a case in which all toner replenishment operation by a toner replenishing device is not completed while the developing device is still being driven, thereby causing toner concentration fluctuation to occur. To prevent such a toner concentration fluctuation, it is preferred that the unreplenished portion of the toner replenishment amount excluding the already replenished amount be replenished at a time when the drive of the developing device is resumed.

When the power to the image forming apparatus is turned off until the drive of the developing device is resumed after it has been stopped, there is a disadvantage in that the information relating to the unreplenished portion of the toner replenishment amount is lost when the above information is not stored in a nonvolatile memory or the like. If the above information is lost, the unreplenished toner is not replenished after the drive of the developing device has been resumed, and the necessary amount of toner is not supplied to the developing device, thereby causing the toner concentration of the developer inside the developing device to be decreased.

SUMMARY OF THE INVENTION

Accordingly, the present invention provides a novel image forming apparatus capable of preventing the toner concentration inside the developing device from decreasing.

As an aspect of the present invention, an image forming apparatus includes a latent image carrier to carry a latent image thereon, an image data obtaining unit to obtain image information, a latent image forming unit to form a latent image on the latent image carrier based on the image information, a developing device to carry a developer including toner and a carrier on a developer carrier moving surface to convey it toward a developing area in which the developer carrier and the latent image carrier faces, and deposit the toner of the developer onto the latent image carried on the latent image carrier in the developing area to thereby develop the latent image, a toner replenishing device to replenish toner to the developing device, and a control unit to control a toner replenishment amount by controlling a drive of the toner replenishing device based on the image information. In such an image forming apparatus, when the drive of the developing device is stopped, information relating to the unreplenished toner replenishment amount subtracting the already-replenished toner amount among the image information-based toner replenishment amount is stored in a nonvolatile memory, and the toner replenishing device is so controlled as to be driven based on the information relating to the unreplenished toner replenishment amount when the drive of the developing unit is resumed.

These and other objects, features, and advantages of the present invention will become apparent upon consideration of the following description of the preferred embodiments of the present invention when taken in conjunction with the accompanying drawings.

DESCRIPTION OF THE PREFERRED EMBODIMENTS

Preferred embodiments of the present invention applied to an electrophotographic printer as an image forming apparatus will now be described with reference to drawings.

First Embodiment

A description will now be given of a basic structure of the printer according to a first embodiment, with initial reference to FIG. 2.

Figure 2:
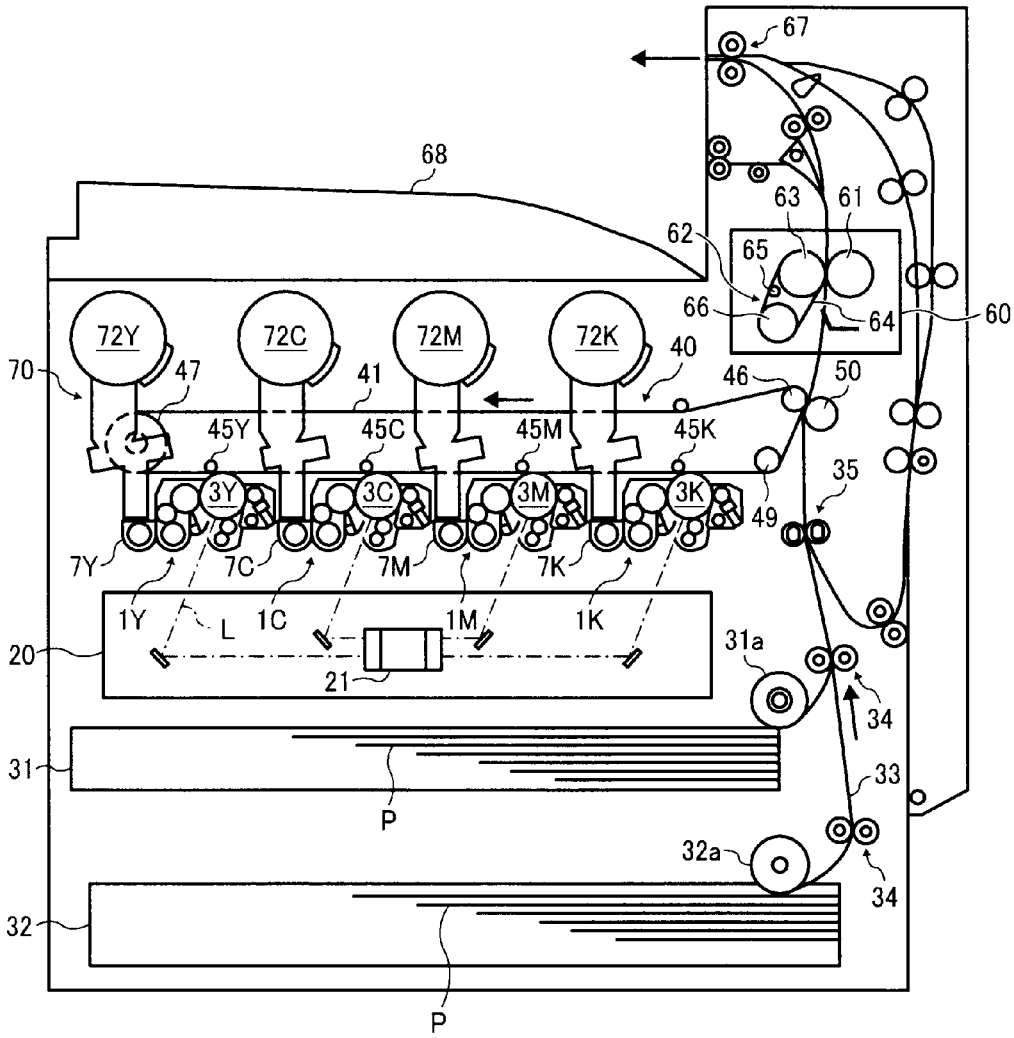
FIG. 2 is a schematic configuration of a printer according to an embodiment of the present invention.

FIG. 2 is a schematic configuration of the printer according to the present embodiment. The printer includes four process units 1Y, 1C, 1M, and 1K for colors of yellow (Y), cyan (C), magenta (M), and black (K), respectively. The process units 1Y, 1C, 1M, and 1K employ different colors from each other as image forming materials, but otherwise are identical in structure.

Figure 3:
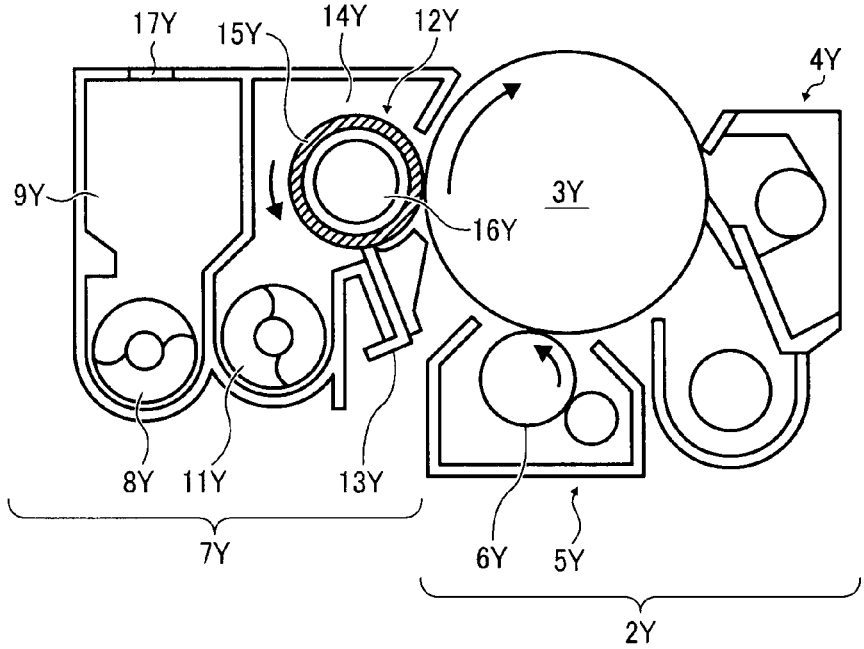
FIG. 3 is an enlarged general outline of a process unit to form a Y-toner image in the printer of FIG. 2.
Figure 4:
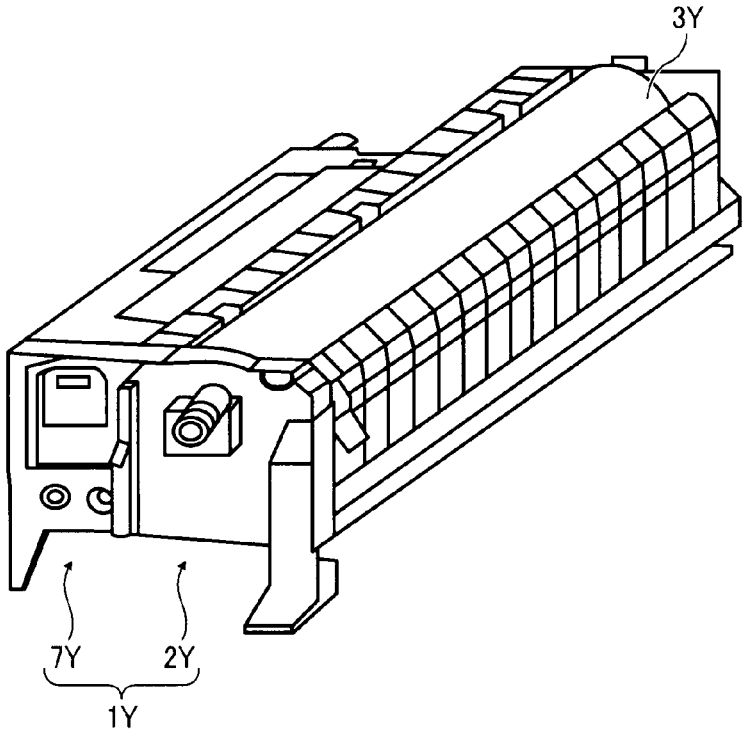
FIG. 4 is an oblique perspective view illustrating an external appearance of the process unit in FIG. 3.

FIG. 3 is a schematic view of the process unit 1Y which forms Y-toner images. FIG. 4 is an oblique perspective view illustrating an exterior appearance of the process unit 1Y. As illustrated in FIGS. 3 and 4, the process unit 1Y includes a photoreceptor unit 2Y and a developing device 7Y. As illustrated in FIG. 4, the photoreceptor unit 2Y and the developing device 7Y are integrally formed as the process unit 1Y which is detachably attached to a printer body. It is noted that, when the process unit 1Y is detached from the printer body, the developing device 7Y can be detached from the photoreceptor unit 2Y.

As illustrated in FIG. 3, the photoreceptor unit 2Y includes a drum-shaped photoreceptor 3Y being a latent image carrier, a drum cleaning device 4Y, a discharger (not shown), and a charger 5Y. The charger 5Y includes a charging roller 6Y to serve as a charging means. The charging roller 6Y uniformly charges a surface of the photoreceptor 3Y which rotates in the clockwise direction in FIG. 3 driven by a drive means, not shown. Specifically, a charging bias is applied from a power source to the charging roller 6Y which rotates counterclockwise, and when the charging roller 6Y comes to or contacts the photoreceptor 3Y, the photoreceptor 3Y is uniformly charged. Alternatively, instead of the charging roller 6Y, any other charging member such as a charging brush may be used as a member to come close to or contact the photoreceptor 3Y. A scorotron charger may be used to uniformly charge the surface of the photoreceptor 3Y. The thus uniformly charged surface of the photoreceptor 3Y by the charger 5Y is exposure-scanned by a laser beam emitted from an optical writing unit 20 serving as a latent image formation means, and carries a latent image of Y-color.

Figure 5:
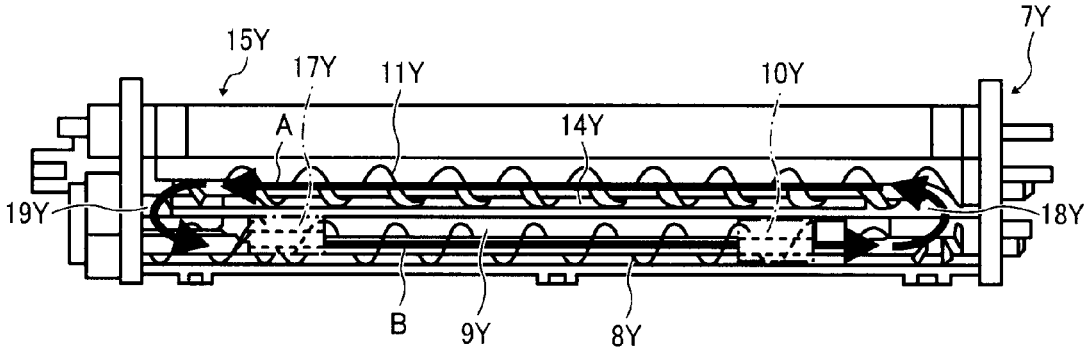
FIG. 5 is a block diagram illustrating part of a developing device in the process unit in FIG. 3.

FIG. 5 is an exploded view illustrating an interior of the developing device 7Y. The developing device 7Y, serving as a developing means, includes a first developer container 9Y to which a first conveyance screw 8Y serving as a developer conveying means is provided. The developing device 7Y further includes a second developer container 14Y to which a second conveyance screw 11Y serving as a developer conveying means, a developing roller 12Y serving as a developer carrier, a doctor blade 13Y serving as a developer regulating member, and the like. These two developer containers forming circulating passages include Y-developer, not shown, which is formed of magnetic carriers and negatively charged Y-toner.

The first conveyance screw 8Y rotates driven by a drive means, not shown, and conveys Y-developer inside the first developer container 9Y toward a front side in FIG. 3 and in arrow A direction in FIG. 5. Then, the Y-developer conveyed by the first conveyance screw 8Y up to the end of the first developer container 9Y enters into the second developer container 14Y via a through opening 18Y.

The second conveyance screw 11Y inside the second developer container 14Y is driven to rotate by the drive means, not shown, thereby conveying the Y-developer to a depth side in FIG. 3 and arrow A direction in FIG. 5. A developing roller 12Y is disposed above and parallel to the second conveyance screw 11Y as illustrated in FIG. 3.

The developing roller 12Y includes a developing sleeve 15Y, formed of non-magnetic materials and rotating in the counterclockwise direction in FIG. 3, and a built-in magnet roller 16Y fixedly disposed in the interior of the developing sleeve 15Y. Part of the Y-developer conveyed by the second conveyance screw 11Y is scooped up on the surface of the developing sleeve 15Y by a magnetic force generated by the magnet roller 16Y. A doctor blade 13Y is so disposed as to maintain a predetermined gap with the surface of the developing sleeve 15Y, and regulates a layer thickness of the scooped-up developer. The developing sleeve 15Y of which the surface layer thickness has been regulated by the doctor blade 13Y is conveyed to the developing area facing the photoreceptor 3Y, and deposits Y-toner on the Y-electrostatic latent image formed on the photoreceptor 3Y.

The Y-developer from which Y-toner is consumed by the developing operation returns on the second conveyance screw 11Y by a rotation of the developing sleeve 15Y, is conveyed to the edge portion of the second developer container 14Y by the second conveyance screw 11Y, and returns to the first developer container 9Y via the through opening 19Y. The Y-developer is thus circulated inside the developing device.

Figure 6:
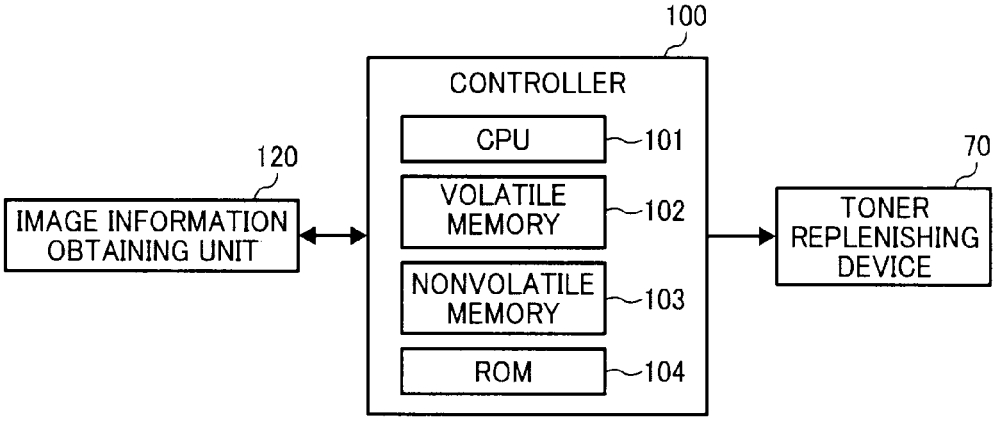
FIG. 6 is a block diagram illustrating part of electrical circuit of the printer.

FIG. 6 is a block diagram illustrating part of an electric circuit of the present printer. A controller 100 includes a central processing unit (CPU) 101 as a computing means, a volatile memory 102, a nonvolatile memory 103, both memories as data storage means, a read-only memory (ROM) 104, and the like, and performs various computing operations and executes various control programs. The volatile memory 102 and the nonvolatile memory 103 may be implemented as random access memories (RAMs).

As illustrated in FIG. 2, the toner image formed on the photoreceptor 3Y is intermediately transferred to the intermediate transfer belt 41 (that is, the intermediate transfer process). The drum cleaning device 4Y of the photoreceptor unit 2Y removes toner remaining on the surface of the photoreceptor 3Y after the intermediate transfer process. With this structure, the surface of the photoreceptor 3Y to which the cleaning process has been applied is then electrically-discharged by a discharger, not shown. By this discharging, the surface of the photoreceptor 3Y is initialized and is prepared for next image formation. In the other process units 1C, 1M, and 1K, C-toner image, M-toner image, and K-toner image are formed similarly, respectively on the process units 1C, 1M, and 1K, and are intermediately transferred onto the intermediate transfer belt 41.

As illustrated in FIG. 2, the optical writing unit 20 is disposed below the process units 1Y, 1C, 1M, and 1K. The optical unit 20 radiates laser light L emitted based on the image information onto the photoreceptors 3Y, 3C, 3M, and 3K of the respective process units 1Y, 1C, 1M, and 1K. With this structure, latent images of Y, C, M, and K are respectively formed on the photoreceptors 3Y, 3C, 3M, and 3K.

While a polygon mirror 21 rotatably driven by a motor is deflecting the laser light L emitted from the light source, the optical writing unit 20 radiates the laser light L onto the photoreceptors 3Y, 3C, 3M, and 3K, via a plurality of optical lenses and mirrors. The optical writing unit 20 may also employ an LED array instead of the above structure.

A first sheet feed cassette 31 and a second sheet feed cassette 32 are disposed vertically in a stacked manner. Each sheet feed cassette includes a plurality of stacked recording sheets P in a state of sheet bundle. Both a first sheet feed roller 31*a* and a second sheet feed roller 32*a* contact an uppermost recording sheet P.

When a first sheet feed roller 31*a* rotates counterclockwise driven by a drive means, not shown, the uppermost recording sheet P in the first sheet feed cassette 31 is conveyed toward a sheet feed pathway 33 extending vertically from the first cassette 31 as illustrated on the right in FIG. 2. Further, when a second sheet feed roller 32*a* rotates counterclockwise driven by a drive means, not shown, the uppermost recording sheet P in the second sheet feed cassette 32 is conveyed toward the sheet feed pathway 33.

The sheet feed pathway 33 includes a plurality of pairs of conveyance rollers 34. The recording sheet P inserted into this sheet feed pathway 33 is sandwiched by these plurality of pairs of conveyance rollers 34 and is conveyed from a bottom side to upper as illustrated in FIG. 2. A pair of registration rollers 35 is disposed at an end of the sheet feed pathway 33. Upon sandwiching the recording sheet P conveyed from the pair of conveyance rollers 34 between both rollers 35, the pair of registration rollers 35 temporarily stops its rotation. Then, the pair of registration rollers 35 conveys the recording sheet P at a proper timing toward a secondary transfer nip, which will be described later.

A transfer unit 40 is disposed above the process units 1Y, 1C, 1M, and 1K and moves the intermediate transfer belt 41 while stretching it endlessly. The transfer unit 40 includes, in addition to the intermediate transfer belt 41, a belt cleaning unit, a first bracket, a second bracket, four primary transfer rollers 45Y, 45C, 45M, and 45K, a secondary transfer backup roller 46, a drive roller 47, an auxiliary roller, a tension roller 49, and the like. The intermediate transfer belt 41 is stretched over these rollers and moves endlessly by the rotational driving of the drive roller 47.

Each of the four primary transfer rollers 45Y, 45C, 45M, and 45K sandwiches the thus endlessly moving intermediate transfer belt 41, together with the photoreceptors 3Y, 3C, 3M, and 3K, thereby forming a primary transfer nip respectively. A transfer bias (of positive polarity in the present embodiment) having a polarity opposite that of the toner is applied to the inner surface of the intermediate transfer belt 41. While the intermediate transfer belt 41 sequentially passing through the primary transfer nips for Y-color, C-color, M-color, and K-color according to the endless movement, color toner images on the photoreceptors 3Y, 3C, 3M, and 3K are primarily transferred in a superimposed manner onto the outer surface of the intermediate transfer belt 41 to form a 4-color toner image.

The secondary transfer backup roller 46 sandwiches the intermediate transfer belt 41 together with a secondary transfer roller 50 disposed outside the loop of the intermediate transfer belt 41, thereby forming a secondary transfer nip. The previously explained pair of registration rollers 35 sends the recording sheet P sandwiched between rollers to the secondary transfer nip at timing synchronous with the 4-color toner image on the intermediate transfer belt 41.

The 4-color toner image on the intermediate transfer belt 41 is secondarily transferred to the recording sheet P en bloc at the secondary transfer nip by effects of secondary transfer electric field and nip pressure generated between the secondary transfer roller 50 to which secondary transfer bias is applied and the secondary transfer backup roller 46. With the effect of background white color of the recording sheet P, a full-color toner image is formed.

The intermediate transfer belt 41 upon passing through the secondary transfer nip is attached with residual toner after transfer that has not used for the transfer to the recording sheet P. The belt cleaning unit comes into contact with the upper surface of the intermediate transfer belt 41 and scrapes off the residual toner remaining on the intermediate transfer belt 41, thereby removing the residual toner.

The first bracket of the transfer unit 40 is configured to swing about a rotation shaft of the auxiliary roller at a predetermined angle according to the drive of a solenoid, not shown.

In the printer according to the present embodiment, the first bracket is slightly rotated counterclockwise by the drive of the solenoid when forming a monochrome image. Due to this slight rotation, the primary transfer rollers 45Y, 45C, and 45M for Y-color, C-color, and M-color are rotated counterclockwise about a rotation shaft of the auxiliary roller, thereby separating the intermediate transfer belt 41 from the photoreceptors 3Y, 3C, and 3M for Y-color, C-color, and M-color. Then, only the process unit 1K for K-color is rotated among the four process units 1Y, 1C, 1M, and 1K, thereby forming a monochrome image. With this construction, depletion of those process units caused by driving other process units 1Y, 1C, and 1M in the monochrome image formation can be prevented.

A fixing unit 60 serving as a fixing means is disposed above the secondary transfer nip in FIG. 2. This fixing unit 60 includes a press-heat roller 61 having a built-in heat source such as a halogen lamp, and a fixing belt unit 62. The fixing belt unit 62 includes a fixing belt 64, a heat roller 63 having a built-in heat source such as a halogen lamp, a tension roller 65, a drive roller 66, and a temperature sensor, not shown. While being stretched over by the heat roller 63, the tension roller 65, and the drive roller 66, the endless fixing belt 64 is endlessly moved in the counterclockwise direction in FIG. 2. In this endlessly moving process, the fixing belt 64 is heated from a rear side thereof by the heat roller 63. The heat roller 63 over which the thus heated fixing belt 64 is stretched contacts, via the upper surface of the fixing belt 64, the press-heat roller 61 which is driven to rotate in the clockwise direction. Thus, a fixing nip where the press-heat roller 61 and the fixing belt 64 contact is formed.

A temperature sensor, not shown, is disposed at an outer side of the loop of the fixing belt 64 and facing the outer surface of the fixing belt 64 over a predetermined gap. The temperature sensor detects a surface temperature of the fixing belt 64 immediately before the belt 64 enters the fixing nip, and the temperature reading thus obtained is sent to a fixing power supply circuit, not shown. The fixing power supply circuit controls the built-in heat source included in the heat roller 63 and of the built-in heat source included in the press-heat roller 61. With this configuration, the surface temperature of the fixing belt 64 is maintained at approximately 140° C. The recording sheet P, which has passed through the secondary transfer nip, is separated from the intermediate transfer belt 41 and sent into the fixing unit 60. While being conveyed from the lower side to upper being sandwiched between rollers at the fixing nip inside the fixing unit 60, the recoding sheet is heated and pressed by the fixing belt 64 and the full-color toner image is fixed onto the recording sheet P.

The recording sheet P to which the fixing process is applied is discharged outside the printer after passing between rollers of a pair of sheet discharge rollers 67. A stack section 68 is disposed on an upper surface of the printer body. The recording sheet P discharged outside the printer body by the pair of sheet discharge rollers 67 is sequentially stacked on this stack section 68.

Toner bottles 72Y, 72C, 72M, and 72K each are a toner container to include therein each toner of Y-toner, C-toner, M-toner, and K-toner, and disposed above the transfer unit 40. Each color toner inside the toner bottles 72Y, 72C, 72M, and 72K is supplied appropriately to the corresponding developing devices 7Y, 7C, 7M, and 7K of the process units 1Y, 1C, 1M, and 1K. These toner bottles 72Y, 72C, 72M, and 72K are detachably attached to the printer body independently from the process units 1Y, 10, 1M, and 1K.

Figure 7:
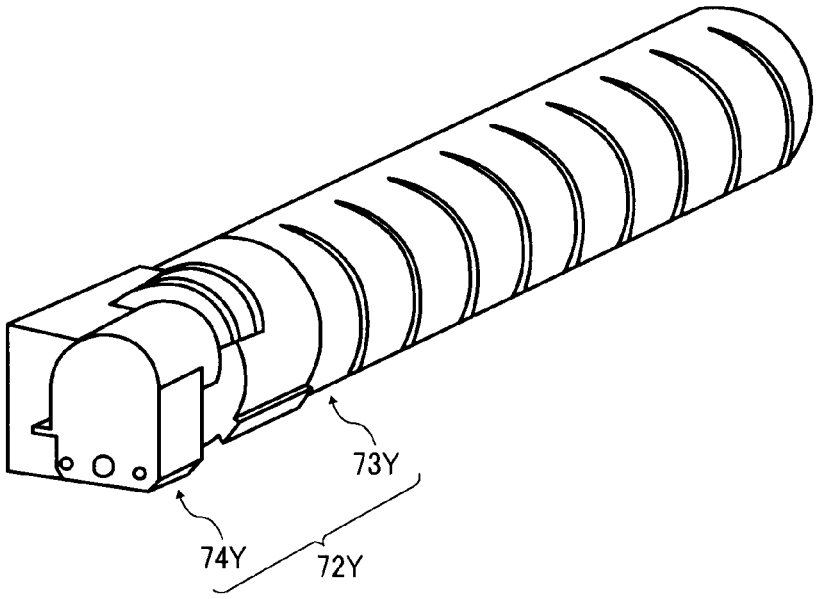
FIG. 7 is an oblique perspective view illustrating a toner bottle for Y-color.
Figure 8:
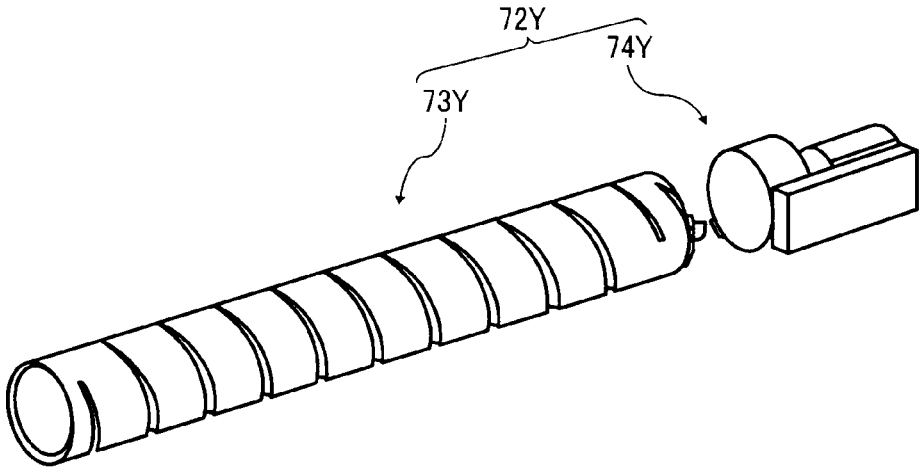
FIG. 8 is an oblique perspective view illustrating a state in which the toner bottle in FIG. 7 is divided into a bottle portion and a holder portion.

FIG. 7 is an oblique view illustrating the toner bottle 72Y for Y-color. As illustrated in FIG. 7, the toner bottle 72Y includes a bottle portion 73Y and a holder portion 74Y. The bottle portion 73Y is configured to include powdery Y-toner, not shown, and the holder portion 74Y has a cylinder shape and serves to discharge the powdery toner. The holder portion 74Y engages with a head of the bottle-shaped bottle portion 73Y and supports the bottle portion 73Y to be rotatable. The bottle 73Y includes screw-shaped spiral projections, or threads, which extend from the bottle inner wall to an interior of the bottle toward an axis line of the bottle.

Figure 9:
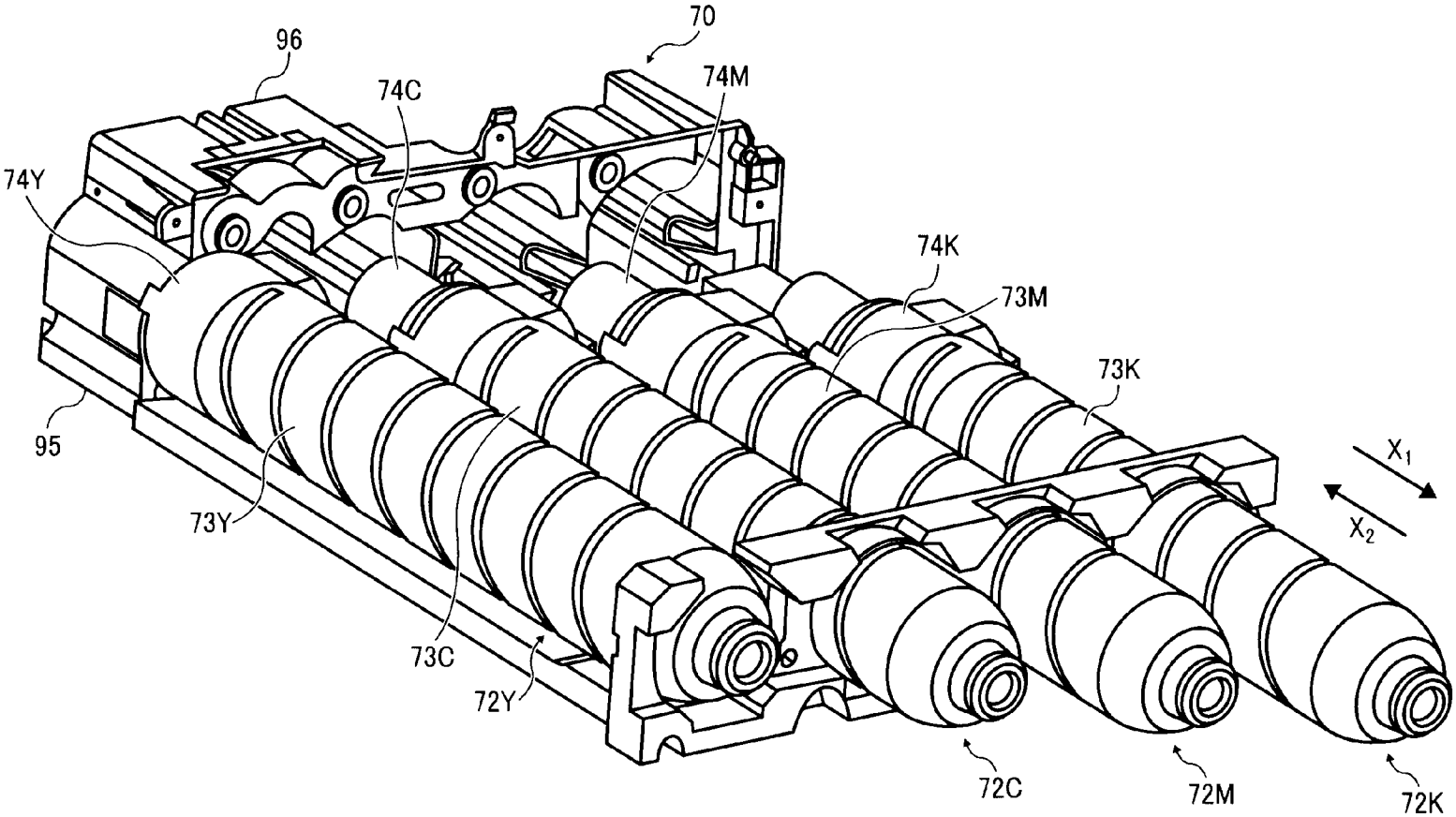
FIG. 9 is an oblique view illustrating a toner replenishing device of the printer.

FIG. 9 is an oblique perspective view of a toner replenishing device 70 of the printer according to one embodiment of the present invention. As illustrated in FIG. 9, the toner replenishing device 70 serving as a toner replenishing means includes four toner bottles 72Y, 72C, 72M, and 72K; a bottle placement rack 95 on which the four toner bottles 72Y, 72C, 72M, and 72K are placed; and a bottle drive section 96 to drive to rotate the bottles individually.

Each holder portion of the toner bottles 72Y, 72C, 72M, and 72K set on the bottle placement rack 95 engages with the bottle drive section 96. When the toner bottle 72K being engaged with the bottle drive section 96 is moved slidably on the bottle placement rack 95 toward a direction separating from the bottle drive section 96 as illustrated by arrow X1 in FIG. 9, the holder portion 74K of the toner bottle 72K is detached from the bottle drive section 96. Thus, the toner bottle 72K is detached from the toner replenishing device 70.

In addition, in a state in which the toner bottle 72K of the toner replenishing device 70 is not attached, when the toner bottle 72K is moved slidably on the bottle placement rack 95 in a direction approaching the bottle drive section 96 as illustrated by arrow X2 in FIG. 9, the holder portion 74K of the toner bottle 72K engages with the bottle drive section 96. Thus, the toner replenishing device 70 can be attached to the toner replenishing device 70.

The other toner bottles 72Y, 72C, and 72M for other toner colors may be attached to and detached from the toner replenishing device by a similar operation as above.

A gear, not shown, is formed to an outer periphery of each of the bottle portions 73Y, 73C, 73M, and 73K of the toner bottles 72Y, 72C, 72M, and 72K. Each of the gears is covered by the holder portions 74Y, 74C, 74M, and 74K, but is partly exposed from a notch formed on the outer periphery of the holder portions 74Y, 74C, 74M, and 74K.

The bottle drive section 96 includes bottle drive gears, not shown, for Y-, C-, M-, and K-toner bottles. When the holder portions 74Y, 74C, 74M, and 74K of the toner bottles 72Y, 72C, 72M, and 72K are engaged with the bottle drive section 96, the bottle drive gears for Y, C, M, and K respectively engage with the gears of the bottle portions 73Y, 73C, 73M, and 73K, via the notch. Due to the rotation of the bottle drive gears for Y, C, M, and K of the bottle drive section 96, driven by a drive system, not shown, the bottle portions 73Y, 73C, 73M, and 73K are driven to rotate on the holder portions 74Y, 74C, 74M, and 74K.

As illustrated in FIG. 7, when the bottle portion 73Y is thus rotated on the holder portion 74Y, the Y-toner inside the bottle portion 73Y moves along the screw-shaped spiral projections from the bottle bottom portion to the bottle top portion. An opening is provided at a tip end of the bottle portion 73Y, through which powdery toner passes. The Y-toner passes through the opening and flows in the cylinder-shaped holder portion 74Y.

Figure 10:
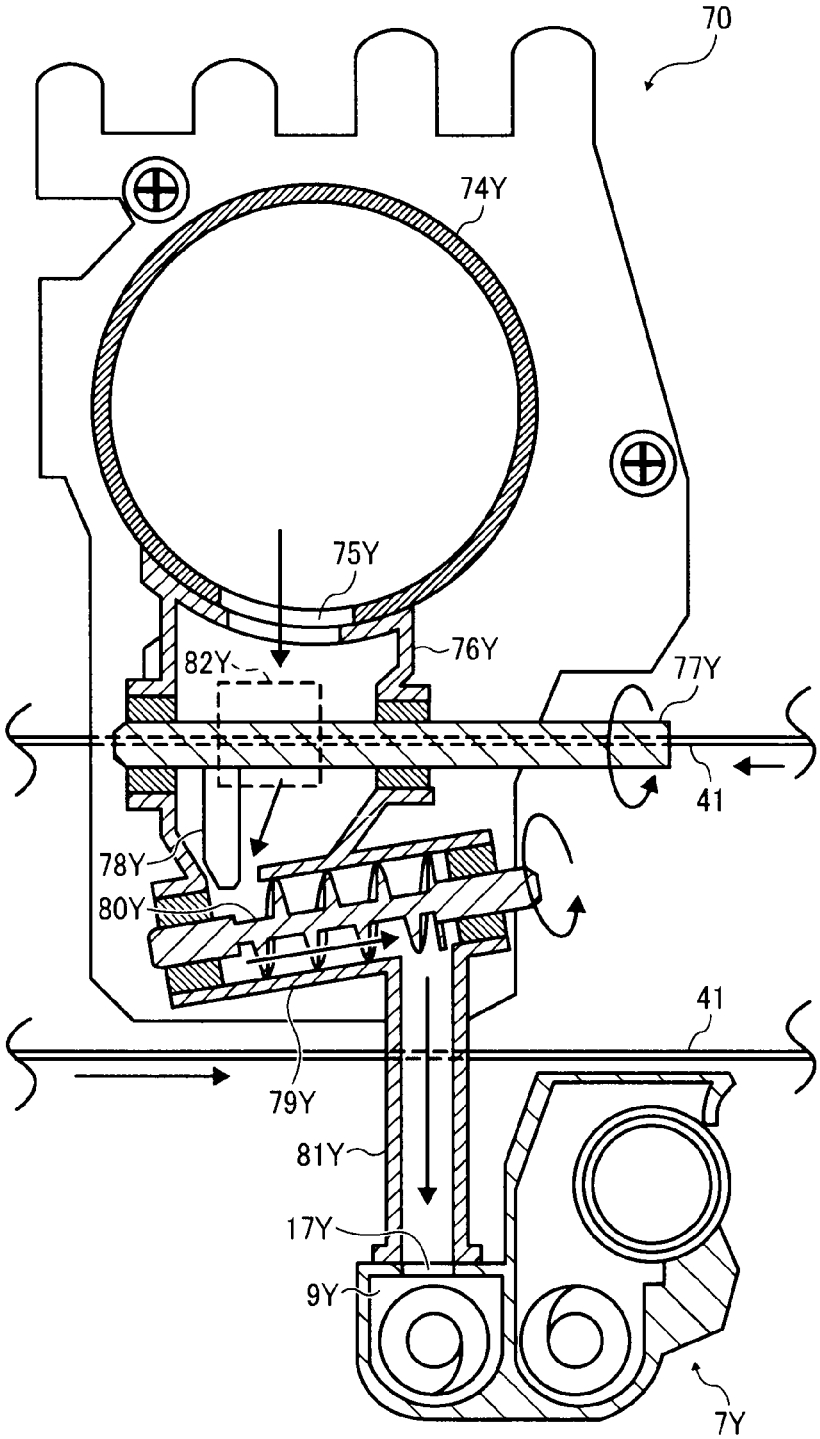
FIG. 10 is a general configuration of the toner bottle, and its peripheral structure, attached to the toner replenishing device.

FIG. 10 is a cross-sectional view schematically illustrating the toner replenishing device 70 when the toner bottle is attached to the toner replenishing device. As illustrated in FIG. 10, the toner bottle is cut at the holder portion 74Y and is illustrated in section. As described above, when the bottle portion is driven to rotate, the Y-toner inside the toner bottle enters into the holder portion 74Y.

The holder portion 74Y of the toner bottle engages with a hopper 76Y of the toner replenishing device 70. This hopper 76Y has a flat shape in the direction perpendicular to the cross section in FIG. 10 and is located at the near side of the intermediate transfer belt 41. A toner discharge port 75Y formed in the bottom of the holder portion 74Y and a toner inlet formed on the hopper 76Y of the toner replenishing device 70 communicate with each other.

The Y-toner sent from the bottle portion of the toner bottle to the holder portion 74Y falls into the hopper 76Y due to its weight. In the hopper 76Y, a flexible pressing film 78Y fixed to a rotational axis member 77Y rotates together with the rotational axis member 77T. A toner detection sensor 82, formed of piezoelectric elements, to detect toner amount inside the hopper 76Y is fixed on an inner surface of the hopper 76Y.

The pressing film 78Y formed of polyethylene terephthalate (PET) film and the like presses the Y-toner toward a detection surface of the toner detection sensor 82. Accordingly, the toner detection sensor 82 can detect a state of toner inside the hopper 76Y appropriately. The rotation of the bottle portion of the toner bottle is controlled so that the toner detection sensor 82 can appropriately detect the Y-toner. As far as a sufficient amount of toner exists in the bottle, a sufficient amount of Y-toner falls into the hopper 76Y via the holder portion 74Y from the bottle portion, and the hopper 76Y is filled with a plenty of toner. When the state changes from this state to another state in which the toner detection sensor 82 cannot detect the Y-toner even though the bottle portion is rotated frequently, a controller, not shown, determines that the Y-toner in the bottle is short and sends a user a warning of "toner near end."

A lateral conveyance tube 79Y is disposed below the hopper 76Y and connected with the hopper 76Y. The Y-toner inside the hopper 76Y slides down along the tapered surface under its own weight and falls into the lateral conveyance tube 79Y. A toner replenishing screw 80Y is disposed in the interior of the lateral conveyance tube 79Y and conveys the Y-toner along a longitudinal direction of the lateral conveyance tube 79Y.

A drop guide tube 81Y connected to an edge portion of the lateral conveyance tube 79Y in the longitudinal direction, extends in the vertical direction. A bottom end of the drop guide tube 81Y connects a toner replenishing port 17Y of a first developer container 9Y of a developing device 7Y. When the toner replenishing screw 80Y in the lateral conveyance tube 79Y rotates, the Y-toner which has been conveyed up to the edge portion of the lateral conveyance tube 79Y in the longitudinal direction falls in the first developer container 9Y of the developing device 7Y via the drop guide tube 81Y and the toner replenishing port 17Y. Accordingly, the Y-toner is replenished in the first developer container 9Y. Other colors of toner (C, M, and K) are also replenished in the similar manner.

Figure 11:
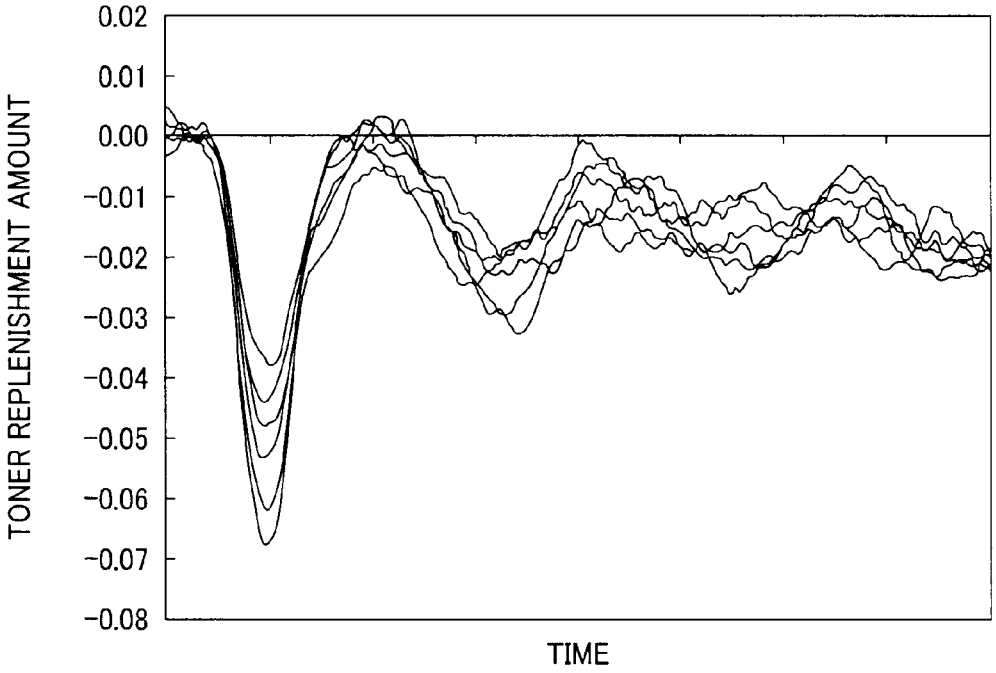
FIG. 11 is a graph illustrating waveforms of the replenished toner amount when the same replenishing operation is repeatedly performed.
Figure 12:
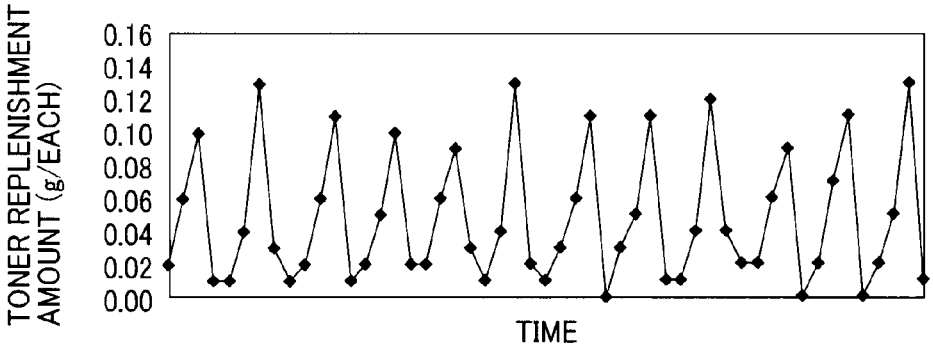
FIG. 12 is a graph illustrating a relation between number of rotations of a toner replenishing screw in the toner replenishing device and a replenished toner amount per one rotation of the screw.

In the structure to replenish toner by the rotation driving of the toner replenishing screw 80Y, the replenishing resolution is not so high. FIG. 11 is a graph illustrating waveforms of the replenished toner amount when the same replenishing operation is repeatedly performed. As illustrated in FIG. 11, even when the same replenishing operation is performed, the replenished toner amount in each replenishing operation fluctuates greatly. The fluctuation in the replenished toner amount becomes drastic as the replenishing operation period per cycle becomes shorter. In addition, the replenished amount may fluctuate with a certain cycle. For example, FIG. 12 is a graph illustrating a relation between number of rotations of the toner replenishing screw 80Y and the replenished toner amount per one rotation, and in this case, the replenished amount drastically increases every four rotations of the screw 80Y.

In the printer according to the present embodiment, a lower limit B is set to the driving period of the toner replenishing device 70, and driving of the toner replenishing device 70 is controlled to secure the driving period of the lower limit B or more. With such replenishment, the fluctuation in the replenished amount in each replenishing operation can be suppressed.

Further, in the printer according to the present embodiment, the driving speed of the toner replenishing device 70 is constant regardless of the necessary replenishing amount per unit time. The replenishing amount per unit time is adjusted by the frequency of driving. During the period when the necessary replenishing amount per unit time is comparably large, the frequency of the driving is high. By contrast, during the period when the necessary replenishing amount per unit time is comparably small, the frequency of the driving is low.

Figure 13:
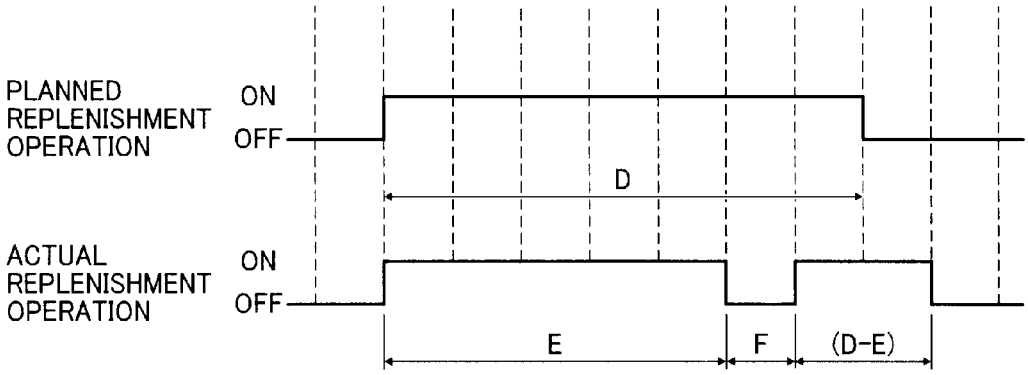
FIG. 13 is a timing chart illustrating an upper limit E of a driving time of the replenishing operation of the toner replenishing device.

When images with high image coverage ratio are continuously output under the above control, as illustrated in an upper column in FIG. 13, there occurs a case in which driving over a certain long period continues. In the present printer, however, when the replenishing operation continues during a time D, a great deal of toner may burst into the first developer container 9Y. This 'burst into' phenomenon occurs such that a great deal of new toner flows into the hopper 76Y as illustrated in FIG. 10 from the bottle portion to cause abundant air to intervene between toner particles, thereby drastically increasing the fluidity of toner. As a result, toner uncontrollably flows under its own weight in the spiral area of the toner replenishing screw 80Y inside the lateral conveyance tube 79Y. If the toner bursting into phenomenon occurs, the toner is replenished uncontrollably.

To solve the above problem, the printer according to the present embodiment provides an upper limit E to the driving time of the replenishing operation as illustrated in a lower column in FIG. 13. When the continued driving is expected to exceed the upper limit E, after the driving is performed during the upper limit E, the driving is interrupted during an interrupted period F, and the remained driving (that is, the upper-limit-E subtracted time from the scheduled period D) is to be performed. As such, the occurrence of the toner 'bursting into' may be prevented.

Figure 14:
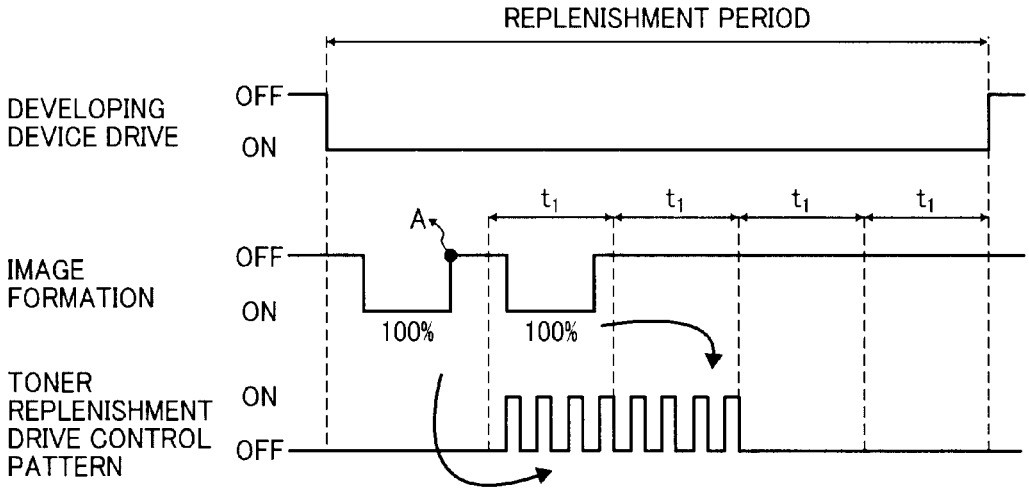
FIG. 14 PRIOR ART
FIG. 14 is a timing chart illustrating a toner replenishing control in the conventional image forming apparatus.

Herein, a toner replenishing control in the conventional image forming apparatus will now be described. FIG. 14 is a timing chart illustrating the toner replenishing control in the conventional image forming apparatus. In FIG. 14, t1 shows time required to output an A4-sized recording sheet. In the conventional toner replenishing control, when a toner consumption amount has been estimated based on the image coverage ratio of a previous page (at time A), an entire toner amount corresponding to the estimated toner consumption amount is replenished within the time period for outputting a next page. Even though in the previous page an image is output with a maximum output dots of entire black solid image (having an image coverage ration of 100%) on the A4-sized recording sheet, as illustrated in FIG. 14, the toner replenishment corresponding to the great deal of toner consumption by such output is performed at once when outputting the next page. However, because the toner concentration fluctuation due to the toner consumption outputted in the previous page occurs in the first developer container 9Y over the period of outputting following several pages, the toner replenishment in the conventional method is not performed in such a manner to cancel out the toner concentration fluctuation waveform occurring in the first developer container 9Y.

First Example

Figure 17:
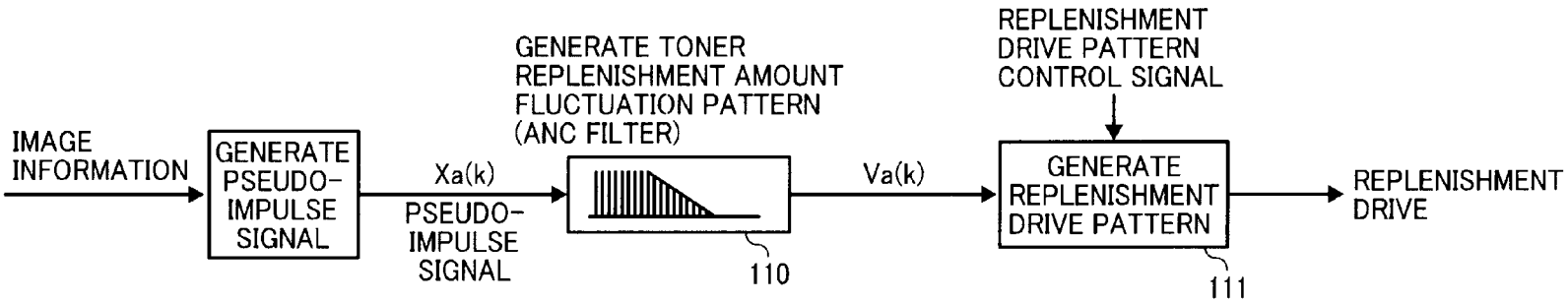
FIG. 17 is a block diagram illustrating part of the circuit structure of the controller according to a first example.
Figure 18:
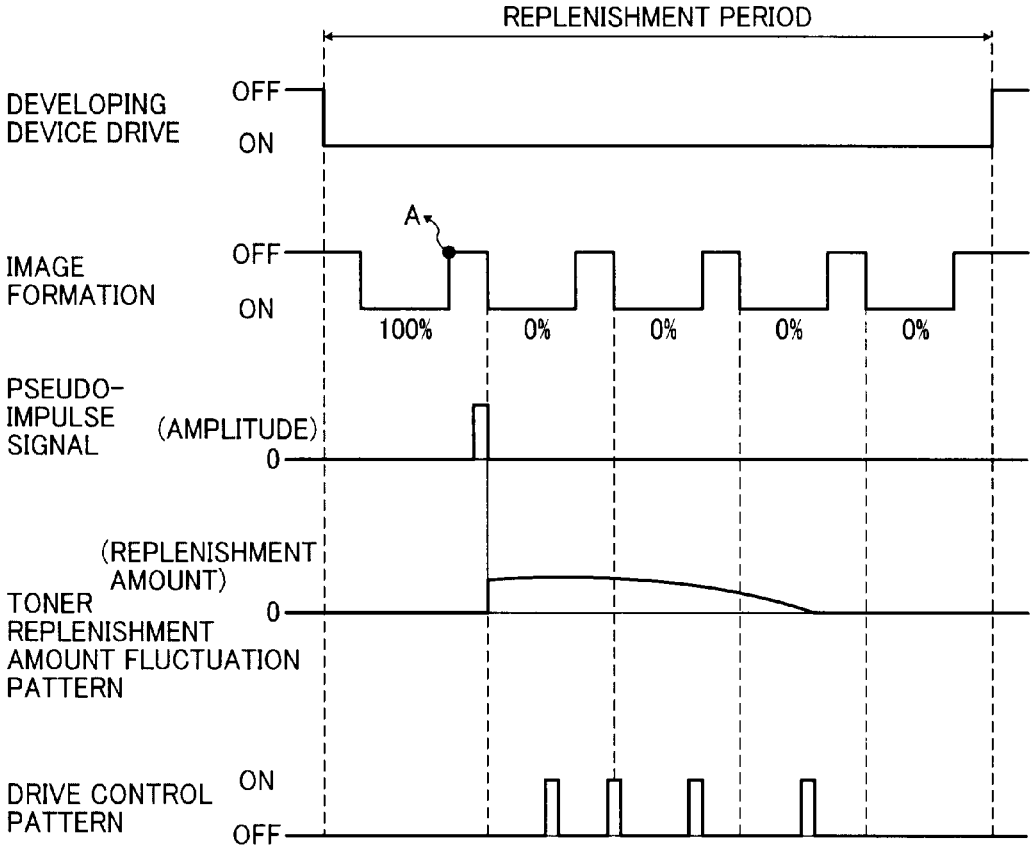
FIG. 18 is a timing chart from obtaining image information to replenishing toner according to the structure shown in FIG. 17.

FIG. 17 is a block diagram illustrating part of the circuit structure of the controller according to a first example. FIG. 18 is a flow from obtaining image information to replenishing toner according to the structure shown in FIG. 17. To generate a fluctuation pattern of the toner replenishment amount with a timing such that the resulting waveform of the replenishing operation becomes an opposite phase of the consumption waveform by print outputs, a pseudo-impulse signal of a rectangular shape of an amplitude corresponding to an image area obtained from the image information that an image information obtaining unit 120 obtains, is input to an ANC filter 110. The ANC filter 110 functions as a toner replenishment amount fluctuation pattern generating circuit. If such a pseudo-impulse is input to the ANC filter 110, a toner replenishment amount fluctuation pattern having an opposite phase waveform to the consumption waveform due to the print outputs as a result of replenishing operation is output from the ANC filter 110.

Here, the toner replenishment amount fluctuation pattern is a pattern capable of implementing replenishment according to a correct opposite phase waveform if the toner replenishing device 70 operates as indicated by the pattern. However, considering the mechanical limitations of the toner replenishing device 70, a final driving control pattern is generated.

Figure 19:
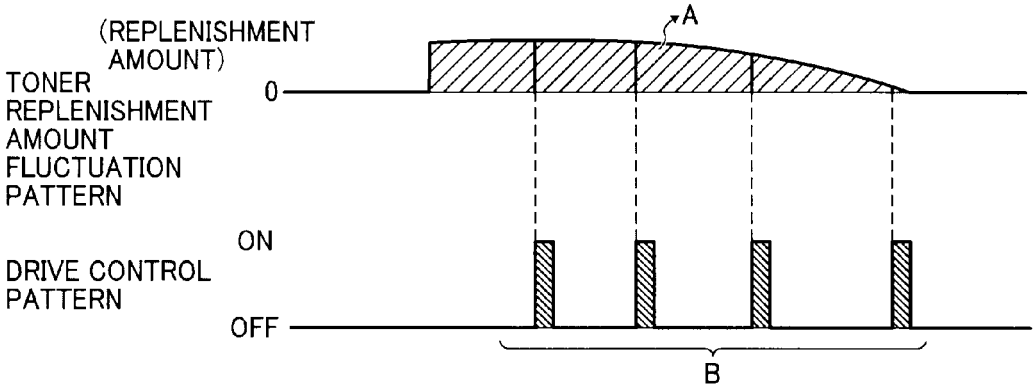
FIG. 19 is a diagram illustrating a relation between the replenishment amount fluctuation pattern and a drive control pattern.

As one example of the mechanical restrictions, FIG. 19 shows a case in which the replenishment amount by the toner replenishing device 70 includes a lower limit. Ideally, the toner is replenished in conformity with a toner replenishment amount fluctuation pattern as indicated by pattern A in FIG. 19. But the pattern is sequentially integrated and a driving control pattern as indicated by pattern B to replenish toner is formed upon arriving at the lowest value. When an excessive replenishment prevention signal from an outside controller or the like is received by the drive pattern generation circuit, a measure to change the toner replenishment amount or to stop replenishment is taken.

Figure 20:
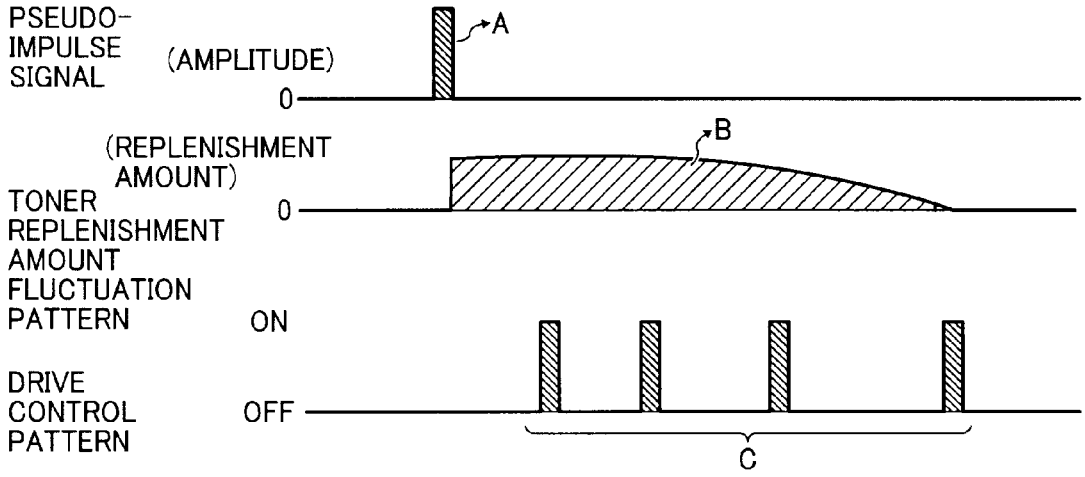
FIG. 20 is a diagram illustrating a relation among a pseudo-impulse-signal A, a total of the toner replenishment amount fluctuation pattern B, and a total of the drive control pattern C.

Alternatively, the pseudo-impulse signal indicates a toner replenishment amount corresponding to the toner consumption as a result of printing operation obtained from the image information. By passing the pseudo-impulse signal through the ANC filter 110 to generate a toner replenishment amount fluctuation pattern, the toner replenishment is performed in a distributed manner. Accordingly, as illustrated in FIG. 20, without any input from outside in particular, the toner replenishment amount caused by each of the pseudo-impulse-signal A, a total of the toner replenishment amount fluctuation pattern B, and a total of the drive control pattern C is in general the same.

Figure 21:
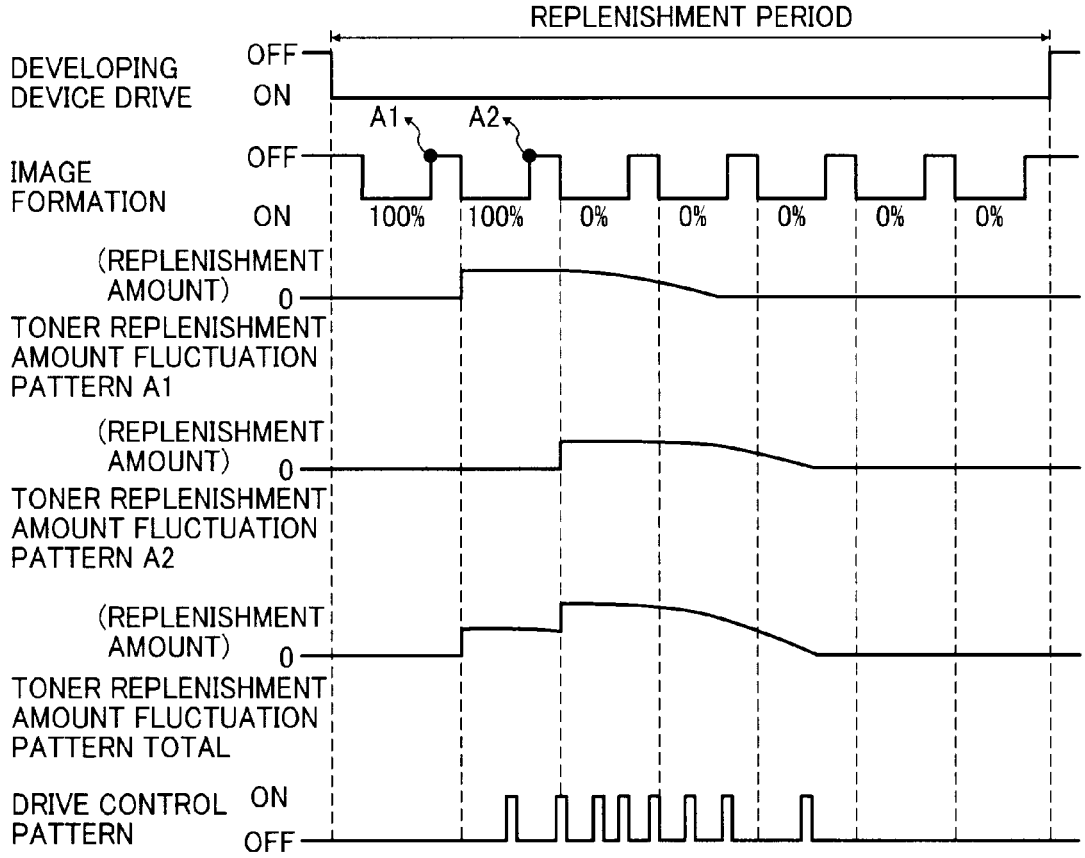
FIG. 21 is a timing chart in a case in which a plurality of toner replenishment amount fluctuation patterns is superimposed.

A case in which image information is contained in one sheet only to be printed-out was described above. In a case in which a plurality of prints are consecutively performed, the pseudo-impulse signals each depending on the image information are sequentially inserted into the ANC filter 110 as illustrated in FIG. 21. The image information obtained by A1 and A2 turns into an automatically superimposed toner replenishment fluctuation pattern. The toner replenishment operation is performed based on the finally obtained replenishment drive pattern.

Figure 22:
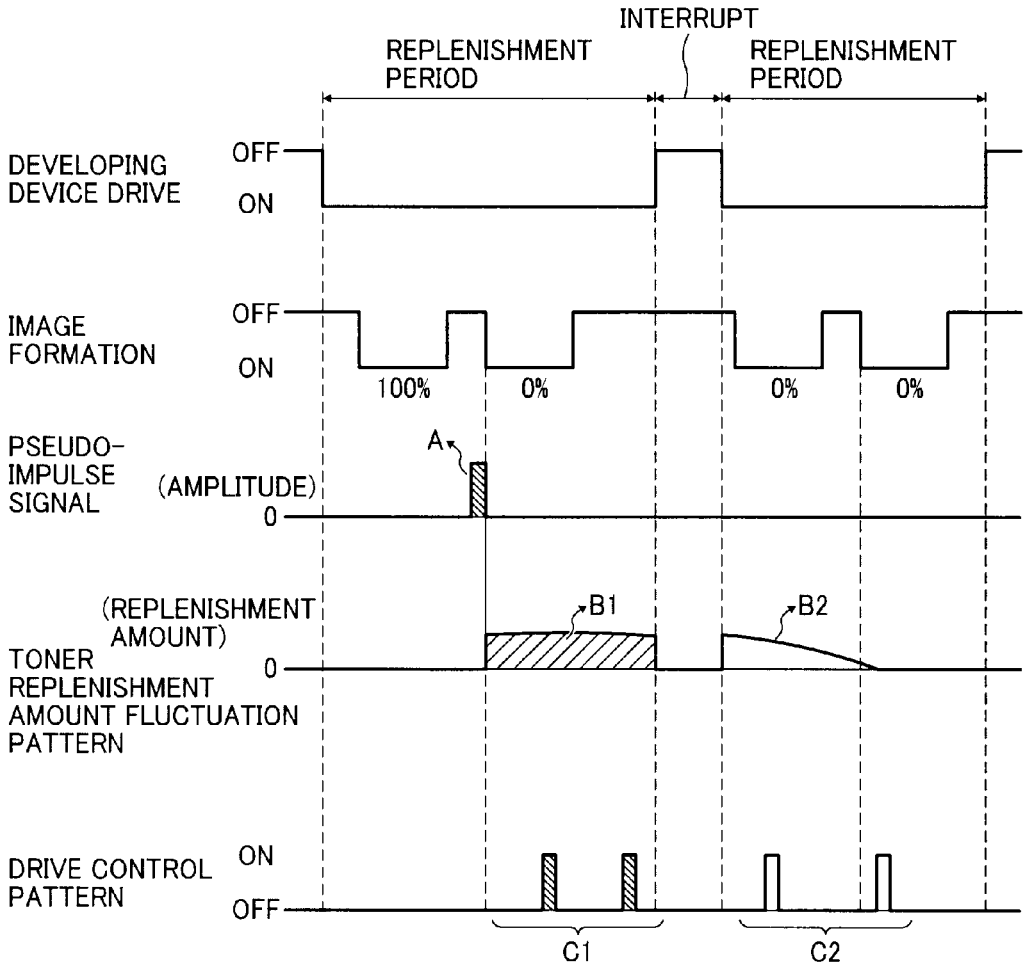
FIG. 22 is a timing chart in a case in which a toner replenishment fluctuation pattern is divided into a toner replenished pattern and a toner unreplenished pattern.

A case in which power on/off signal is received when the printing is interrupted will now be described. As illustrated in FIG. 22, when the toner replenishment amount fluctuation pattern B1 by the pseudo-impulse signal A is interrupted, the total amount B2 to be replenished after the power is resumed equals to A-B1.

In this case, when all information of the ANC filter 110 (that is, all information relating to the toner replenishment amount fluctuation pattern) is stored in the memory, a number of memories are required.

Figure 15:
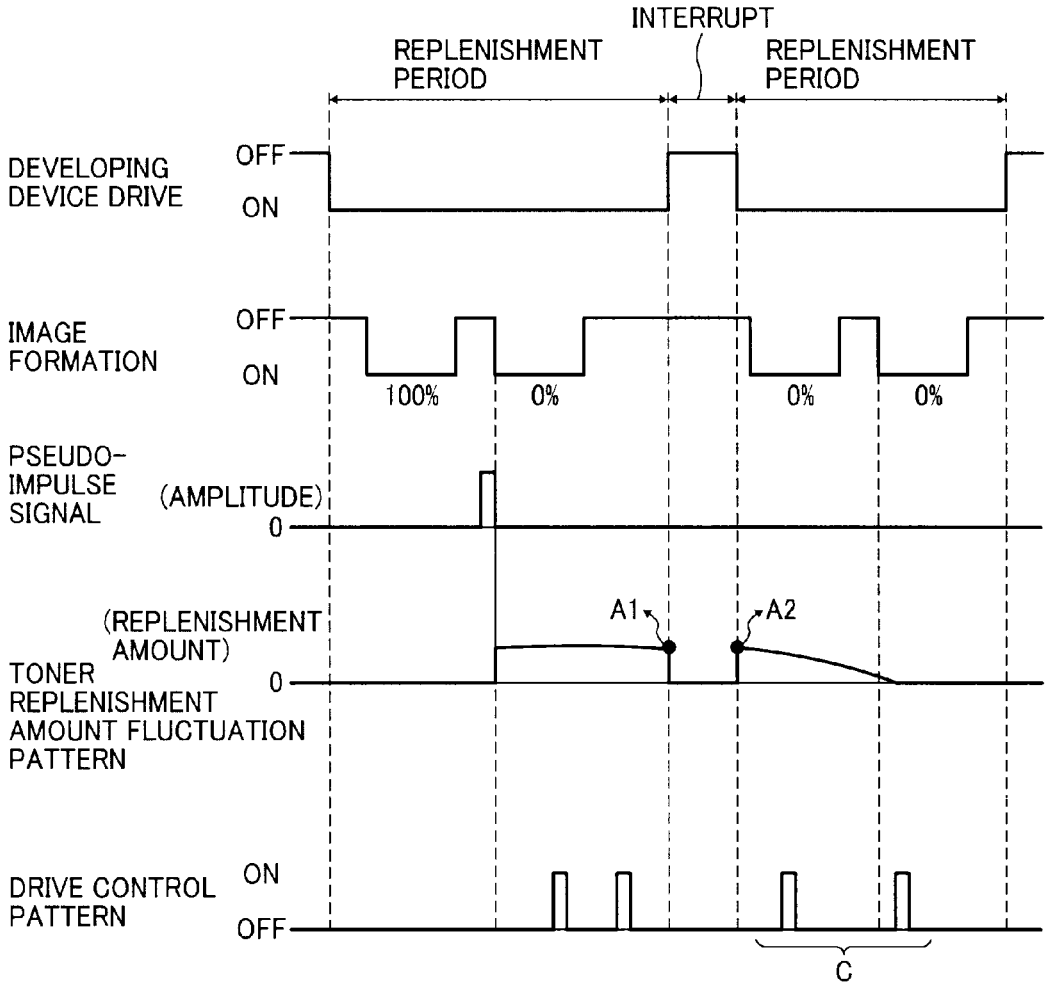
FIG. 15 PRIOR ART
FIG. 15 is a timing chart illustrating a case in which all state amounts inside the ANC filter (or the quarternary III filter) are stored when printing operation is interrupted.

FIG. 15 shows a case in which a quarternary IIR filter is used to generate the toner replenishment amount fluctuation pattern. Assume that the printing is interrupted and the power is turned off. To resume the operation under the same conditions, the data should be stored at Point A1, and the stored data should be read out at Point A2. In general, the quarternary IIR filter requires a total of eight memories for each of four time sequences of Xa and Va, each of which is an inner state variable (see below).

[ANC Filter Internal Operation]

$$Va(k)=-[Aa1*Va(k-1)+Aa2*Va(k-2)+Aa3*Va(k-3)+Aa4*Va(k-4)<-\text{Output}+[Ba1*Xa(k-1)+Ba2*Xa(k-2)+Ba3*Xa(k-3)+Ba4*Xa(k-4)<-\text{Input}$$

Aa1 to Aa4: Output Factor

Ba1 to Ba4: Input Factor

In addition, in a case in which the driving control pattern is previously generated from the toner replenishment amount fluctuation pattern, as indicated by pattern C in FIG. 15, timings of replenishment driving of two times and each replenishment amount need to be stored, meaning that more memories may be required depending on the type of pattern.

Figure 16:
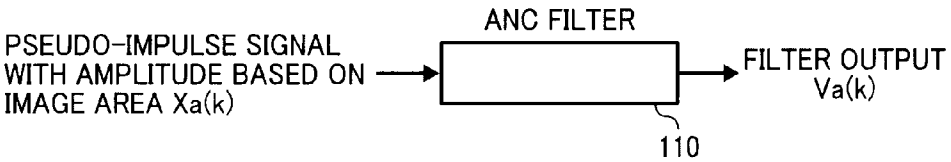
FIG. 16 PRIOR ART
FIG. 16 is a diagram illustrating a toner replenishment amount fluctuation pattern generation circuit or ANC filter according to the conventional image forming apparatus.

By contrast, according to the present embodiment, a toner replenishment amount is obtained by arithmetic operation in accordance with the non-converted component/portion of the toner replenishment amount fluctuation pattern, which is a difference between the pseudo-impulse signal input to the ANC filter 110 and the output from the ANC filter 110, and is stored in the nonvolatile memory 103. It is to be noted that although eight memories are required in the conventional operation as illustrated in FIG. 16, in the present embodiment the number of memories is only one, accomplished by adding the toner replenishment amount in accordance with the non-converted component/portion from the image information to the toner replenishment amount fluctuation pattern.

Figure 1:
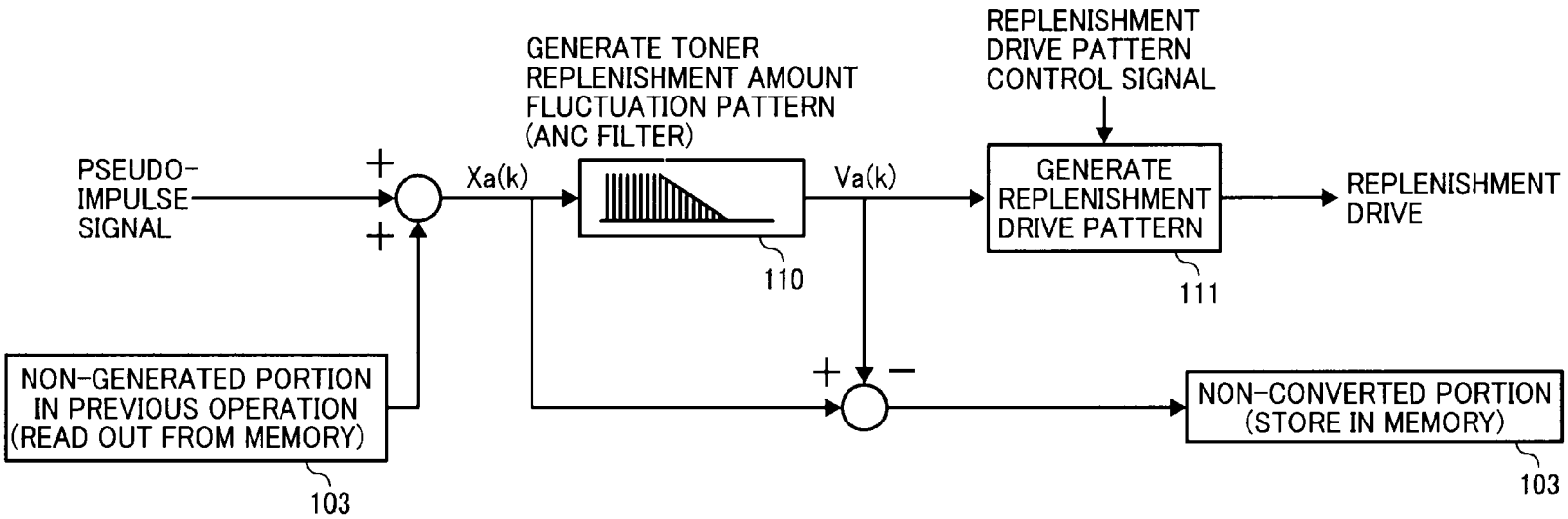
FIG. 1 is a block diagram illustrating part of a circuit configuration of a controller when a non-converted portion of a toner replenishment amount stored in a nonvolatile memory is again input in an ANC filter as a pseudo-impulse signal.

When resuming the printing operation, the toner replenishment amount corresponding to the non-converted component/portion stored in the nonvolatile memory 103 is again input to the ANC filter 110 as a pseudo-impulse signal as illustrated in FIG. 1, thereby enabling replenishment of a toner amount corresponding to the image area.

It is to be noted that the ANC filter 110 used herein is not limited to any particular type of filter, such as IIR filters or FIR filters, nor to any particular difference in order or filter length. Moreover, any other method using a table may also be used to obtain the same effect as that of the ANC filter 110 described above.

Second Example

Figure 23:
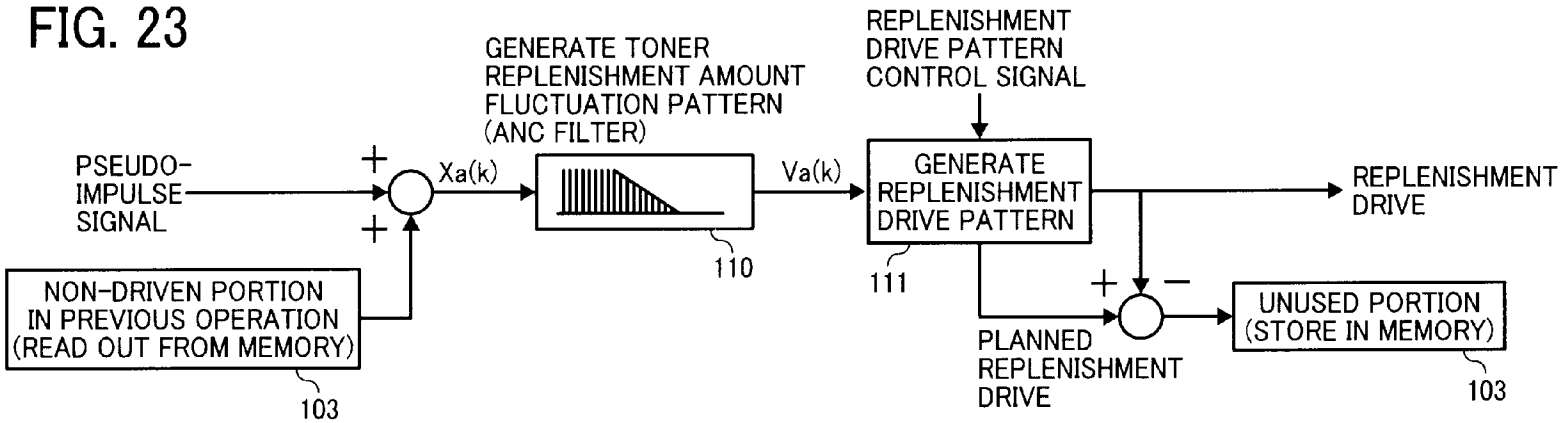
FIG. 23 is a block diagram illustrating part of the circuit configuration of the controller in a case in which an unused portion of the replenishment drive pattern stored in the nonvolatile memory is again input to the ANC filter as a pseudo-impulse signal at a time when printing operation is resumed.

FIG. 23 is a block diagram illustrating part of the circuit configuration of the controller 100 in which unused portion of the drive control pattern stored in the nonvolatile memory 103 is again input to the ANC filter 110 as a pseudo-impulse signal when printing operation is resumed according to a second example.

In the second example, when stopping the drive of the developing device 7, the unused portion of the drive control pattern is calculated and stored in the nonvolatile memory 103. The stored value is used and input for the toner replenishment amount fluctuation pattern when the driving of the development device 7 is resumed. Specifically, when the printing is interrupted, as illustrated in FIG. 23, the replenishing drive unimplemented amount being the difference between the replenishment drive planned amount and the actual replenishment drive amount is calculated, and the obtained value is stored in the nonvolatile memory 103 as a toner replenishment amount corresponding to the unused portion of the drive control pattern, thereby enabling to use only one memory. When the printing is resumed, the toner replenishment amount corresponding to the unused portion stored in the nonvolatile memory 103 is input again to the ANC filter 110 as a pseudo-impulse signal, thereby enabling replenishment of a toner amount corresponding to the image area.

Figure 24:
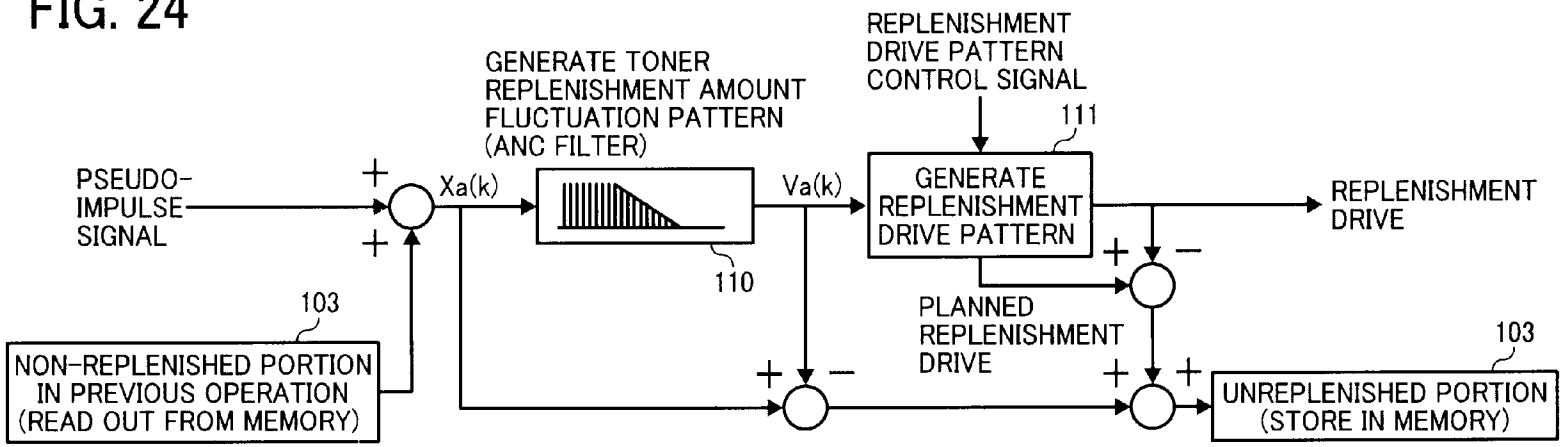
FIG. 24 is a block diagram illustrating part of the circuit configuration of the controller in a case in which a non-converted portion of the toner replenishment fluctuation pattern and an unused portion of the replenishing drive pattern, the both being stored in the nonvolatile memory, is again input to the ANC filter as a pseudo-impulse signal.

As illustrated in FIG. 24, when stopping the drive of the developing device 7, the toner replenishment amount corresponding to the non-converted portion of the toner replenishment fluctuation pattern and the toner replenishment amount corresponding to the unused portion of the drive control pattern are stored in the nonvolatile memory 103 as a unreplenished toner amount, and when resuming the printing, the toner replenishment amount of the unreplenished portion stored in the nonvolatile memory 103 is input to the ANC filer 110 as a pseudo-impulse signal, thereby enabling replenishment of a toner amount corresponding to the image area.

Third Example

The toner replenishment amount is calculated upon receiving image information and the calculated toner replenishment amount is stored in the nonvolatile memory 103. Thus, even when the power to the printer is turned off at any arbitrary timing, the toner replenishment amount corresponding to the image information is stored in the memory. However, when calculating the toner replenishment amount fluctuation pattern using the ANC filter 110, normally, the calculation is performed at a sampling cycle shorter than the time to print a single sheet. If the data is stored in the nonvolatile memory 103 at such a short cycle, the writing number exceeds the maximum rewritable number of the nonvolatile memory 103, to thus shorten its lifetime.

Figure 25:
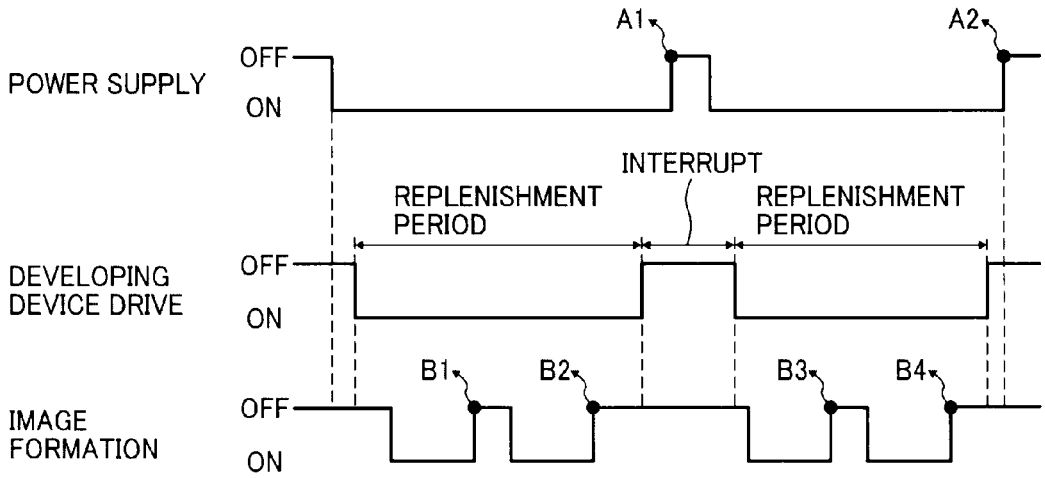
FIG. 25 is a timing chart illustrating a case in which data is stored in the nonvolatile memory during the power-off period.

In addition, even though storing the data into the memory is performed each time when a sheet is printed out, as shown by B1 to B4 in FIG. 25, several times of storing operation is required.

By contrast, because the user does not normally turn off the power during the printing operation, it is enough to store the data in the nonvolatile memory 103 twice at A1 and A2 as illustrated in FIG. 25 when the power is turned off at a time of completion of printing.

Then, in the third example, the data relating to the toner replenishment amount and the like is stored in the nonvolatile memory 103 when the power is turned off at a time of completion of printing. With this structure, the frequency to write data into the nonvolatile memory 103 is reduced, a plurality of nonvolatile memories need not provided to secure the total number of writing operation, thereby suppressing the cost increase.

Fourth Example

Figure 26:
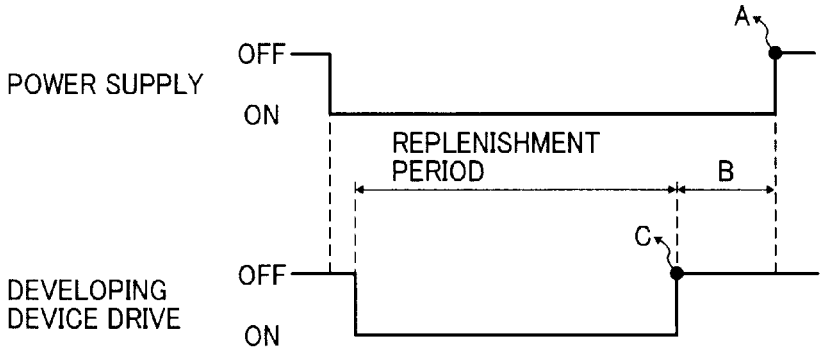
FIG. 26 is a timing chart illustrating a case in which data is stored in the nonvolatile memory at a print job end.

As illustrated in FIG. 26, a period B of from several tens of seconds to several minutes is normally allowed from a so-called job end (at point C) being a print end to the power off (at point A) for power saving, and the image forming apparatus itself turns off its power or is transferred to the energy-saving mode.

However, certain users keen about the energy saving, may manually turns off the apparatus immediately after the print end without waiting for the normal power off between the period from the print end (at point C) to the power off (at point A). In this case, because there is a time lag between the print end (at point C) and the power off (at point A) as described above, if storing data into the nonvolatile memory 103 is performed at an automatic power-off timing, the toner replenishment amount data temporarily stored in the volatile memory 102 is lost when the power is manually turned off by the user in the period B. Then, when the power is turned on again, the unused toner replenishment amount data is not obtained and the replenishment of toner corresponding to the image area cannot be performed continuously.

Then, in the present embodiment, by storing the data of the unimplemented toner replenishment amount in the nonvolatile memory 103 immediately after the print end or job end, the data of the unimplemented toner replenishment amount may be stored before the abrupt manual turnoff by the user.

Fifth Example

In the aforementioned embodiments, when the toner replenishment amount corresponding to the non-converted portion stored in the nonvolatile memory 103 is input again in the ANC filter 110 as a pseudo-impulse signal when resuming the print operation, the toner replenishment amount fluctuation pattern from the initial stage is created. Thus, even though the total sum of the toner replenishment amount is maintained, the continuity from the previous replenishment result is lost.

Figure 27:
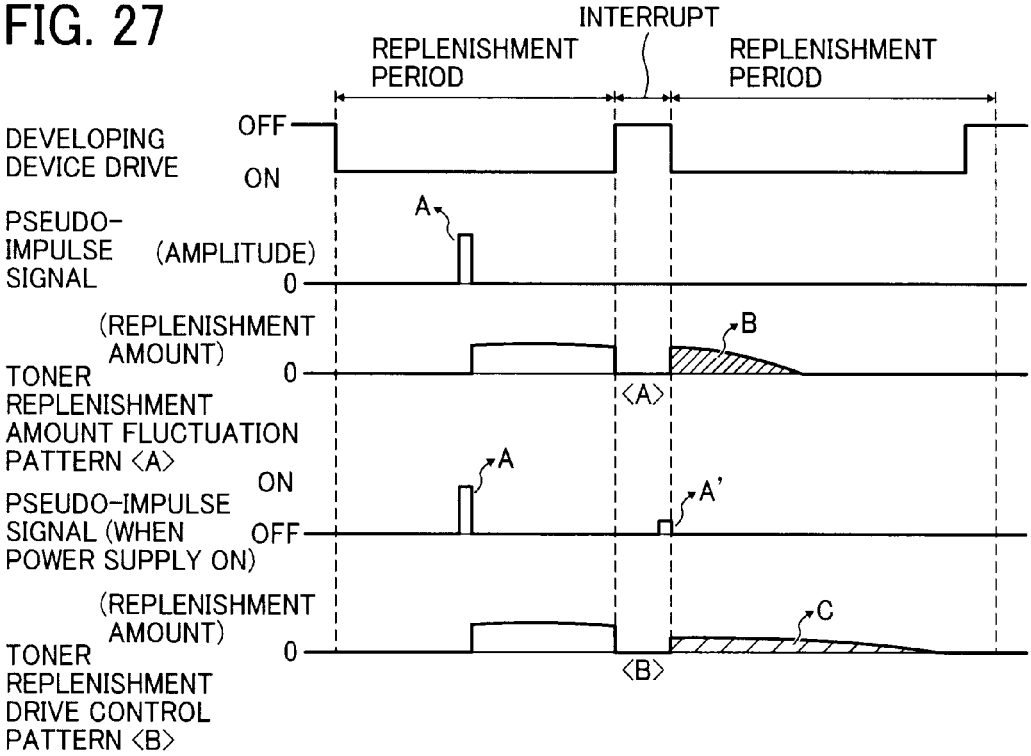
FIG. 27 is a timing chart illustrating a case in which the same replenishment amount fluctuation pattern is generated based on the stored information.

For example, a desired toner replenishment amount fluctuation pattern when the replenishment is resumed in the continued manner is as in pattern B of the toner replenishment amount fluctuation pattern <A> as illustrated in FIG. 27. When the toner replenishment amount corresponding to the non-converted portion stored in the nonvolatile memory 103 is input again in the ANC filter 110 as a pseudo-impulse signal, the output result C of the toner replenishment amount fluctuation pattern <B> is different from the above pattern B desired for the toner replenishment amount fluctuation pattern <A> in FIG. 27.

Figure 28:
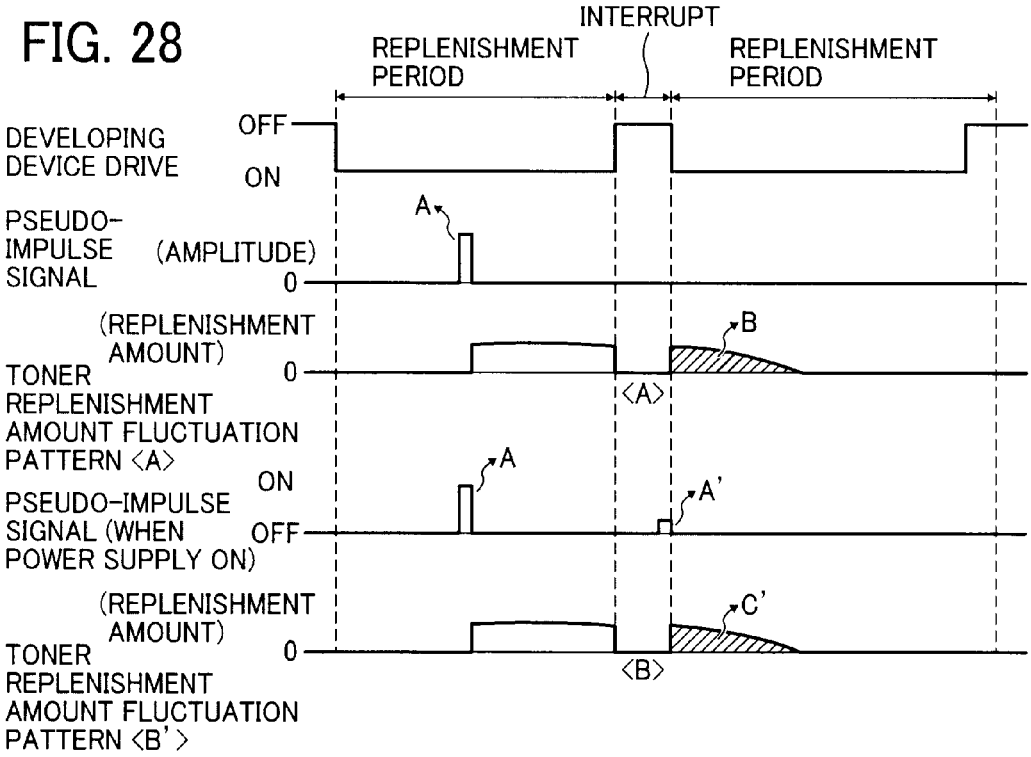
FIG. 28 is a timing chart illustrating a case in which a different replenishment amount fluctuation pattern is generated based on the stored information.
Figure 29:
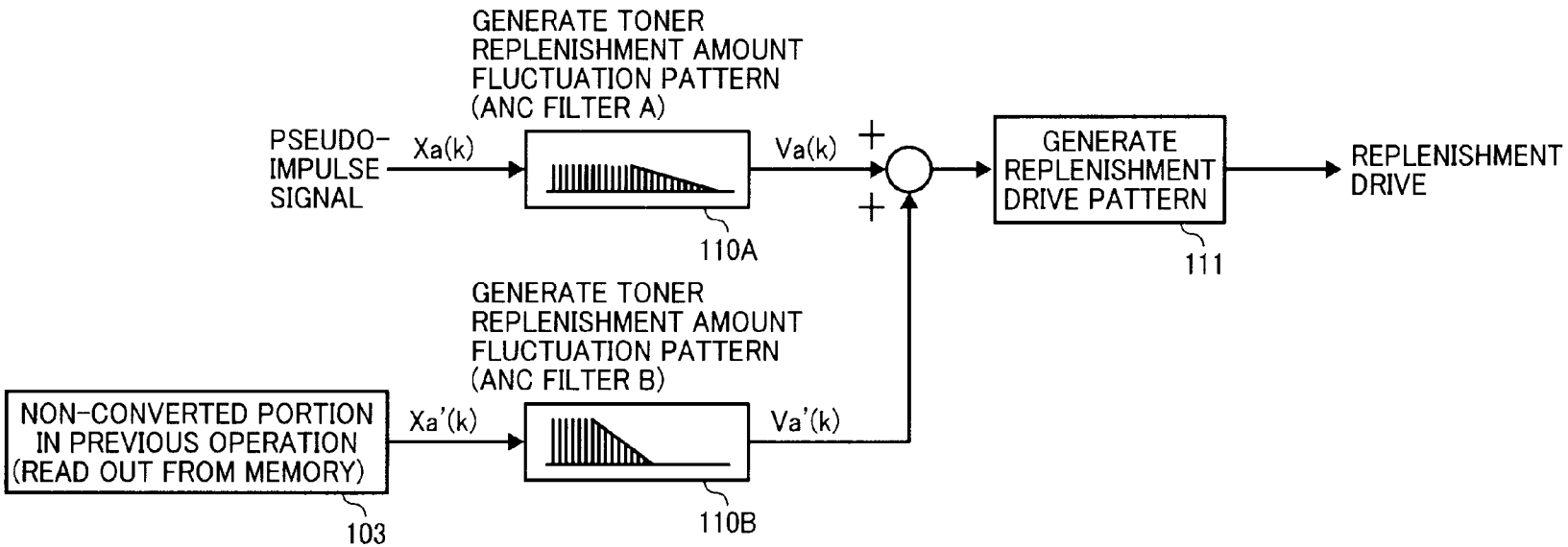
FIG. 29 is a block diagram illustrating part of the circuit diagram of a controller in a case in which a non-converted portion data of the toner replenishment amount fluctuation pattern is stored in another ANC filter from the ANC filter previously used for storing the data.

Then, in the fifth embodiment, to maintain the continuity of the toner replenishment amount fluctuation pattern before and after the replenishment drive operation, the toner replenishment amount corresponding to the non-converted portion stored in the nonvolatile memory 103 is input, as a pseudo-impulse signal, to an ANC filer 110B configured to have a filter shape as illustrated in FIG. 29, so that the output result C' of the toner replenishment amount fluctuation pattern <B'> becomes similar to the output result B of the toner replenishment amount fluctuation pattern <A> as illustrated in FIG. 28.

Sixth Example

Figure 30:
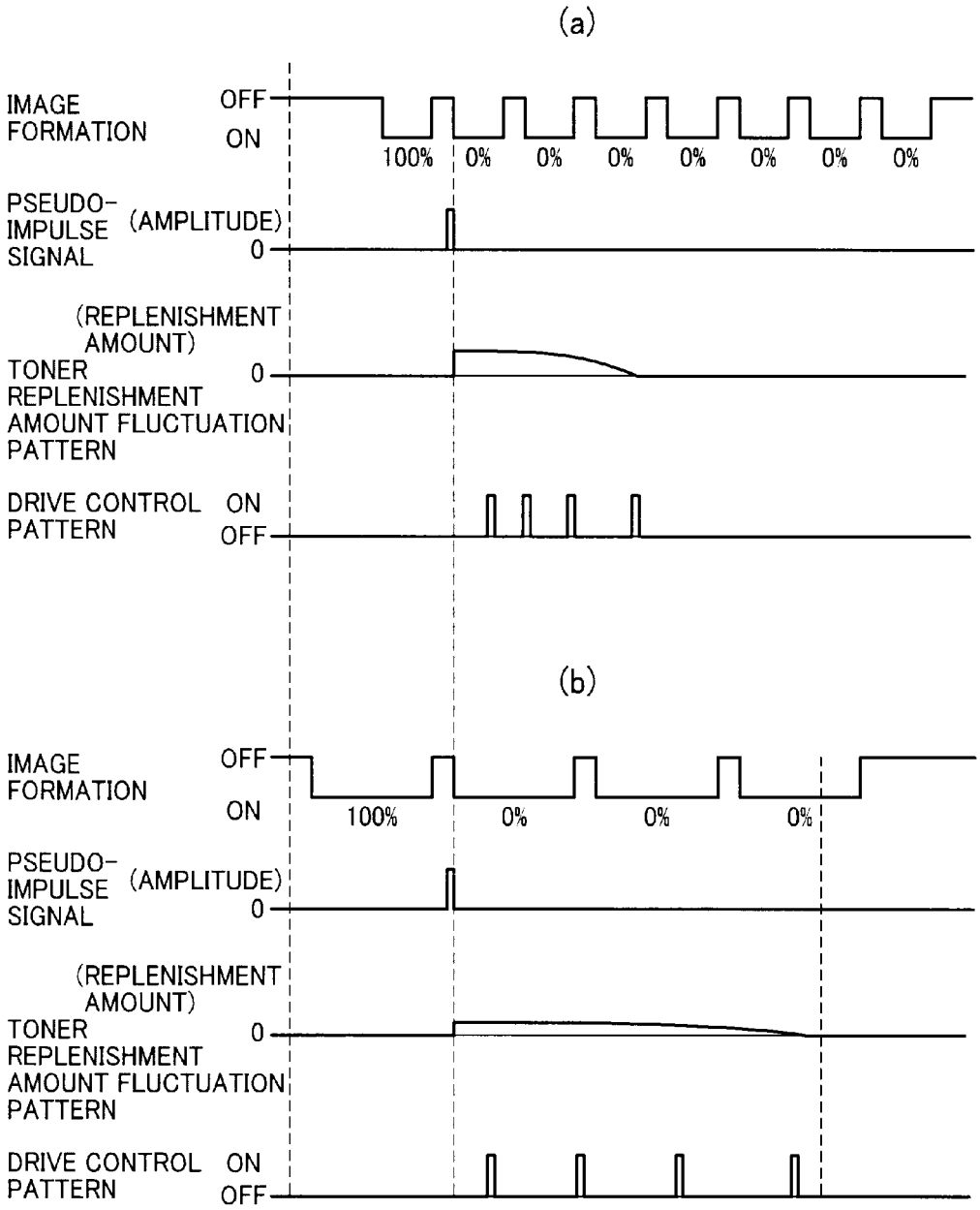
FIG. 30 is a diagram illustrating difference in the replenishment pattern between a standard speed printing and a lower speed printing.

In the image forming apparatus such as a printer or a copier according to the sixth example of the present invention, printing speed or linear speed may be changed depending on the sheet type or sheet thickness, and the like. In this case, the number of rotations of the screws inside the developing device 7 is also changed to thus change the developer conveyance speed. For example, assume that the linear speed for a standard thickness of sheet is a standard speed as indicated by (a) in FIG. 30, and the linear speed for a thick sheet with lower linear speed is indicated by (b) in FIG. 30. Then, if the ratio between the two is 2:1, all development operation in the developing device 7 takes substantially double time in the time axis. In this case, if the toner replenishment amount fluctuation pattern is formed in the fixed cycle, when the standard speed is decreased to the lower speed, toner may be intensively replenished to any predetermined narrower portion inside the developing device 7. In an inverse case, toner replenishment is delayed. Then, when the linear speed is switches over, it is preferred that the toner replenishment pattern be formed according to the ANC filter 110 suitable for the linear speed.

Then, in the present example, a plurality of filters is provided to cope with a plurality of linear speeds. When the linear speed has changed, a portion of the replenishment amount not converted into the toner replenishment amount fluctuation pattern from the previous print information is input to the ANC filer 110 corresponding to the linear speed upon the linear speed change. With this structure, toner replenishment using an appropriate toner replenishment amount fluctuation pattern relative to the linear speed may be performed.

Figure 31:
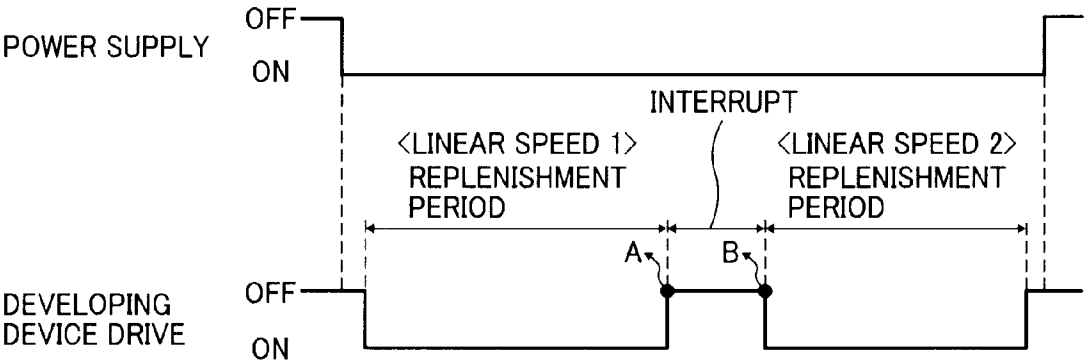
FIG. 31 is a timing chart illustrating a case in which a linear speed 1 is switched over to a linear speed 2.

As illustrated in FIG. 31, there is a case in which the linear speed change occurs regardless of the power on/off operation. In this case, without any relation to the power on/off operation, an unimplemented toner replenishment amount may be input to the ANC filter 110 relative to the linear speed, when the linear speed 1 is switched over to the linear speed 2.

Second Embodiment

Hereinafter, a description will now be given of an electrophotographic printer as one of image forming apparatuses according to a second embodiment. The basic structure of the image forming apparatus is identical to that of the image forming apparatus according to the first embodiment, and the description thereof will be omitted.

In the image forming apparatus according to the first embodiment, to cope with the problem that the toner concentration inside the developing device 7 decreases due to the lack of memory information occurring at the time of power off when the necessary toner amount is not replenished to the developing device 7, the necessary toner amount is stored in a reduced number of memories as unimplemented toner replenishment amount being a difference between before and after the generation of the toner replenishment amount fluctuation pattern or between before and after the generation of the drive pattern, so that the necessary toner replenishment amount may be replenished in accordance with the image information.

However, because the section to calculate the unimplemented toner replenishment amount or the section to additionally input the unimplemented toner replenishment amount stored in the nonvolatile memory is limited and is not suitable for the general purposes. There arises a problem when the unimplemented toner replenishment amount cannot be input due to the system configuration and needs to be input in the distributed manner.

To cope with the above problem, the image forming apparatus according to the second embodiment in which toner replenishment of an inverse phase to offset the toner concentration fluctuation is performed using the image information, is configured such that: unimplemented toner amount is obtained both in a section to generate a necessary toner replenishment amount and its timing and in a section to actually perform toner replenishment; the obtained unimplemented toner replenishment amount is stored in the nonvolatile memory 103 when the power is off; and the stored unimplemented toner replenishment amount is additionally input either or both of the section to generate a necessary toner replenishment amount and its timing and the section to actually perform toner replenishment, thereby satisfying the target toner concentration with high precision and low cost.

A case in which the power is turned on or off while the printing operation is being interrupted will now be described with reference to FIG. 22. When the toner replenishment amount fluctuation pattern by the pseudo-impulse signal A is interrupted at B1, the total amount B2 to be replenished when the printing operation is resumed equals to A-B1. Specifically, difference between the pseudo-impulse signal being an input to the ANC filter 110 and an output from the ANC filter 110 is calculated and is stored in the nonvolatile memory 103, and the non-converted toner amount only is totaled, whereby only one memory is needed. When the printing operation is resumed, the non-converted toner amount is again input to the filter as the pseudo-impulse signal, thereby enabling replenishment of a toner amount corresponding to the image area.

However, there is a possibility that the power is turned on or off at the same time when the drive control pattern C2 obtained by the toner replenishment amount fluctuation pattern B2 has been calculated. In such a case, the calculation result of the drive control pattern C2 may be stored in the nonvolatile memory 103. However, how the content stored in the nonvolatile memory 103 is reflected to the operation may affect the final image quality.

Seventh Example

To cope with the above problem, in the present example, the difference value between the pseudo-impulse signal being an input to the ANC filter 110 and an output from the ANC filter 110, that is, a non-converted value from the image information to the toner replenishment amount fluctuation pattern is stored in the nonvolatile memory 103 when the power is turned off, and the stored difference value between the input to and output from the ANC filter 110 is caused to be reflected to the drive control pattern when the power is turned on.

Figure 32:
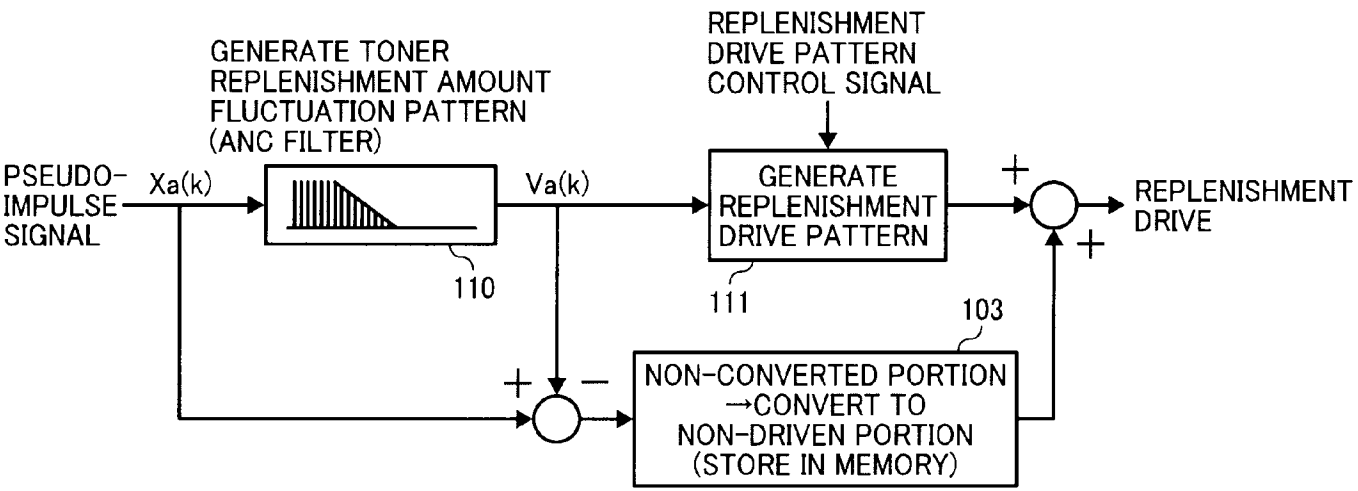
FIG. 32 is a block diagram illustrating part of the circuit configuration of the controller in a case in which the generated drive control pattern and the non-converted portion of the toner replenishment amount fluctuation pattern stored in the nonvolatile memory are subjected to addition and subtraction operation to perform replenishment operation.

FIG. 32 is a block diagram illustrating part of the circuit configuration of the controller 100 in a case in which the generated drive control pattern and the non-converted portion of the toner replenishment amount fluctuation pattern stored in the nonvolatile memory 103 are subjected to addition and subtraction to perform replenishment operation. First, based on the image information, the pseudo-impulse signal corresponding to the image area is input to the ANC filter 110. A difference value between the pseudo-impulse signal being an input to the ANC filer 110 and an output from the ANC filter 110, that is, a non-converted portion of the toner replenishment amount fluctuation pattern is calculated and is stored in the nonvolatile memory 103.

It is noted that any content may be stored in the nonvolatile memory 103 as far as it can be read out when the power is turned on or off, and the content can be read out in various ways and timings such that the nonvolatile memory 103 constantly continues calculation operation, even when the image output has been completed, or after the power-off command has been received.

As illustrated in FIG. 32, the output from the ANC filter 110 is input to the replenishment drive pattern generation circuit 111 so that the drive control pattern is generated. The thus generated drive control pattern and the difference value between the input to and the output from the ANC filer (the non-converted portion of the toner replenishment amount fluctuation pattern) which is stored in the nonvolatile memory 103 are subjected to the addition and subtraction operation and the replenishment driving is performed. In this case, it is preferred that the addition of the drive control pattern generated and output in the replenishment drive pattern generation circuit 111 and the difference value between the input to and the output from the CAN filter stored in the nonvolatile memory 103 (the non-converted portion of the toner replenishment amount fluctuation pattern) be read out from the nonvolatile memory 103 when the power is turned on. In addition, because the type of the signal of the toner replenishment amount fluctuation pattern and that of the drive control pattern are different from each other, the conversion or signal conversion is performed in this addition operation. To simplify, the series of operations are described in one block as illustrated in FIG. 32, including various timings for addition and subtraction.

Accordingly, the information relating to the short portion of the toner replenishment amount not reflected in the toner replenishment, among the toner replenishment amount required from the image information, is stored in the nonvolatile memory 103, thereby suppressing the memory area and finally enabling high quality image formation with low cost.

Eighth Example

In the present example, a toner replenishment amount corresponding to an unused portion of the drive control pattern is stored in the nonvolatile memory when the power is turned off, and the stored toner replenishment amount corresponding to the unused portion of the drive control pattern is reflected to the drive control pattern when the power is turned on.

Figure 33:
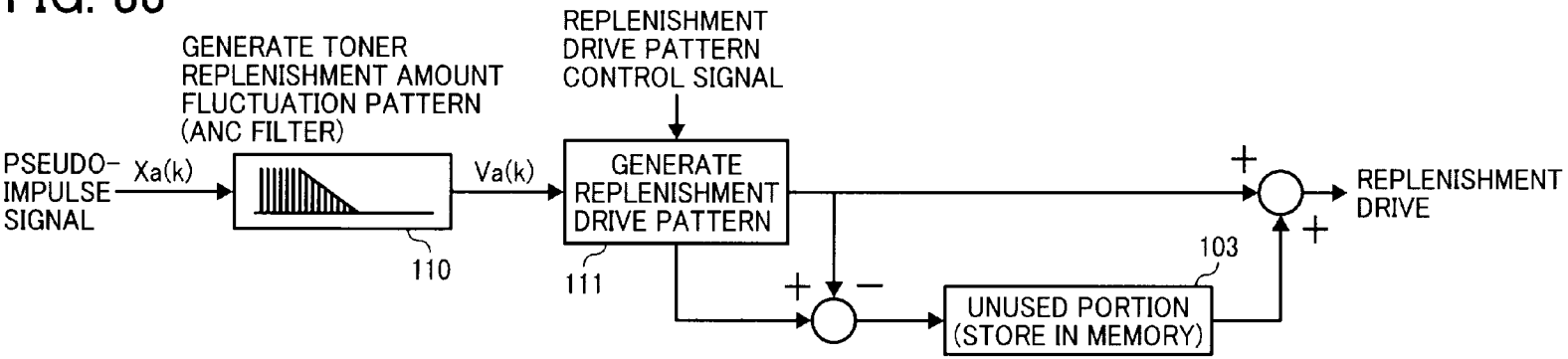
FIG. 33 is a block diagram illustrating part of the circuit configuration of the controller in a case in which the generated drive control pattern and the unused portion of the drive control pattern stored in the nonvolatile memory are subjected to addition and subtraction operation to perform replenishment drive operation.

FIG. 33 is a block diagram illustrating part of the circuit configuration of the controller 100 in a case in which the generated drive control pattern and the unused portion of the drive control pattern stored in the nonvolatile memory 103 are subjected to addition and subtraction operation to perform replenishment drive operation. First, a pseudo-impulse signal corresponding to the image coverage ratio based on the image information is input to the ANC filter 110. Next, an output from the ANC filter 110 is input to the replenishment drive pattern generation circuit 111, thereby forming a drive control pattern. In addition, the difference value between the replenishment drive pattern generated based on the input from the ANC filter 110 to the replenishment drive pattern generation circuit 111 and the drive control pattern divided and output from the replenishment drive pattern generation circuit 111, that is, the unused portion of the drive control pattern is calculated and is stored in the nonvolatile memory 103.

It is noted that the content stored in the nonvolatile memory 103 may only be read out when the power is turned on or off and can be read out in various ways and timings such as, even when the data is constantly calculated in the nonvolatile memory 113, when the image output has been completed, after the power off command has been received.

In the eighth example, the drive control pattern generated in the replenishment drive pattern generation circuit 111 and the difference value between the input to and the output from the replenishment drive pattern generation circuit ill stored in the nonvolatile memory 103 are subjected to addition and subtraction operation to perform the replenishment drive operation. In this case, the addition and subtraction operation of the drive control pattern generated in the replenishment drive pattern generation circuit 111 and the difference value between the input to and the output from the replenishment drive pattern generation circuit 111 (that is, the unused portion of the drive control pattern) may preferably be performed during the power-on period by reading out the data from the nonvolatile memory 103. For simplifying purposes, the series of operations are described in one block as illustrated in FIG. 33, including various timings for addition and subtraction.

Ninth Example

In the ninth example according to the present embodiment, a toner replenishment amount corresponding to the non-converted portion of the toner replenishment amount fluctuation pattern from the image information and a toner replenishment amount corresponding to the unused portion of the drive control pattern are stored in the nonvolatile memory 103 during the power-off period. Then, a toner replenishment amount corresponding to the stored non-converted portion of the tonner replenishment amount fluctuation pattern and a toner replenishment amount corresponding to the unused portion of the drive control pattern are reflected to the drive control pattern during the power-on period.

Figure 34:
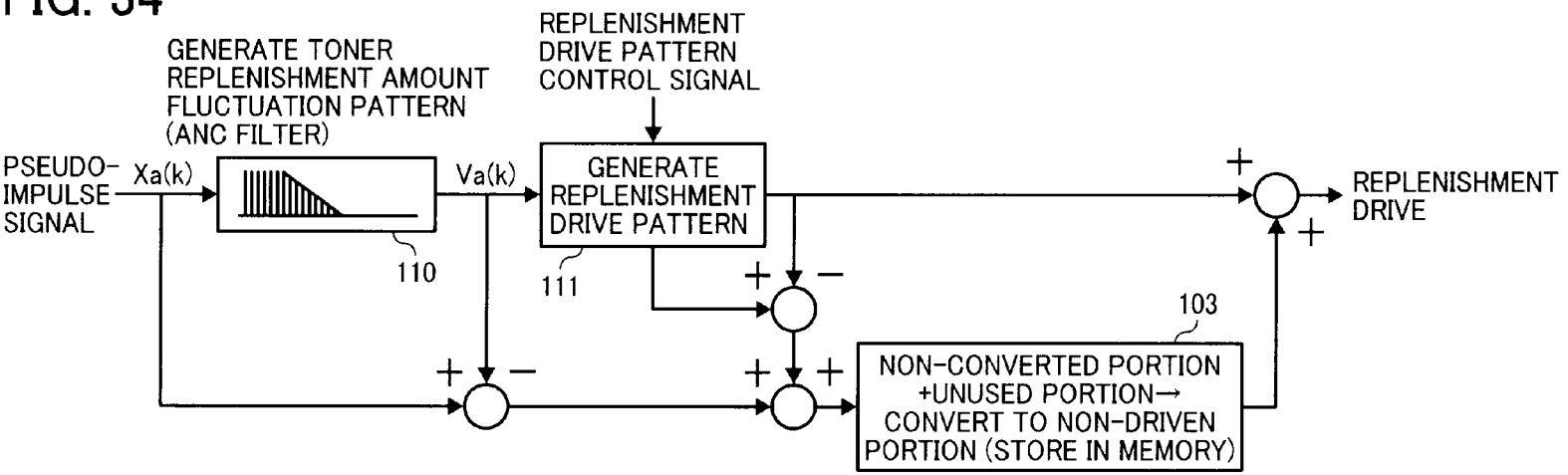
FIG. 34 is a block diagram illustrating part of the circuit configuration of the controller in a case in which the generated drive control pattern, the difference value between the input to and the output from the ANC filter stored in the nonvolatile memory 103, that is, the non-converted portion from the image information to the toner replenishment amount fluctuation pattern, and the difference value between the input to and the output from the replenishment drive pattern generation circuit, that is, the unused portion of the drive control pattern, are subjected to addition and subtraction operation to perform replenishment drive operation.

FIG. 34 is a block diagram illustrating part of the circuit configuration of the controller 100 in a case in which the generated drive control pattern, the difference value between the input to and the output from the ANC filter stored in the nonvolatile memory 103, that is, the non-converted portion from the image information to the toner replenishment amount fluctuation pattern, and the difference value between the input to and the output from the replenishment drive pattern generation circuit, that is, the unused portion of the drive control pattern, are subjected to addition and subtraction operation to perform replenishment drive operation. Base on the image information, a pseudo-impulse signal corresponding to the image coverage ratio is input to the ANC filter 110. Then, the difference value between the pseudo-impulse signal being an input to the ANC filter 110 and the output signal from the ANC filter 110, that is, the difference value between the input to and the output from the ANC filter is calculated to obtain and store the non-converted portion from the image information to the toner replenishment amount fluctuation pattern in the nonvolatile memory 103.

It is noted that the content stored in the nonvolatile memory 103 may only be read out when the power is turned on or off and can be read out in various ways and timings such as, even when the data is constantly calculated in the nonvolatile memory 113, when the image output has been completed, after the power off command has been received.

The output from the ANC filter 110 is input to the replenishment drive pattern generation circuit 111 to form a drive control pattern. Then, a difference value between the replenishment drive pattern generated based on the input from the ANC filer 110 to the replenishment drive pattern generation circuit 111, and the drive control pattern divided and output from the replenishment drive pattern generation circuit 111, that is, the difference value between the input to and the output from the replenishment drive pattern generation circuit 111 or the unused portion of the drive control pattern is calculated and is stored in the nonvolatile memory 103.

It is noted that the content stored in the nonvolatile memory 103 may only be read out when the power is turned on or off and can be read out in various ways and timings such as, even when the data is constantly calculated in the nonvolatile memory 113, when the image output has been completed, after the power off command has been received.

Successively, the difference value between the input to and the output from the ANC filter or the non-converted portion of the toner replenishment amount fluctuation pattern, and the difference value between the input to and the output from the replenishment drive pattern generation circuit or the unused portion of the drive control pattern are added together. As a result of addition operation, the non-driven toner replenishment amount is stored in the nonvolatile memory 103. Here, because the type of the signal of the ANC filer input and output difference value and that of the replenishment drive pattern generation circuit input and output difference value is different from each other, the conversion or signal conversion is preformed in the addition operation and storing operation. Specifically, when the difference value between the input to and the output from the ANC filter or the non-converted portion of the toner replenishment amount fluctuation pattern, and the difference value between the input to and the output from the replenishment drive pattern generation circuit or the unused portion of the drive control pattern are subjected to addition operation or stored in the nonvolatile memory 103, signal conversion is performed to unify the both types of signals.

It is noted that the content stored in the nonvolatile memory 103 may only be read out when the power is turned on or off and can be read out in various ways and timings such as, even when the data is constantly calculated in the nonvolatile memory 113, when the image output has been completed, after the power off command has been received.

In the present example 9, the toner replenishment amount of the drive control pattern generated in the replenishment drive pattern generation circuit 111 and the toner replenishment amount of the non-driven portion stored in the nonvolatile memory 103 are subjected to addition and subtraction operation to perform replenishment drive operation of the toner replenishing device. In this case, the addition/subtraction operation between the toner replenishment amount of the drive control pattern generated in the replenishment drive pattern generation circuit 111 and the toner replenishment amount of the non-driven portion may only be performed during the power-on period by retrieving the stored data from the nonvolatile memory 103. For simplifying purposes, the series of operations are described in one block as illustrated in FIG. 34, including various timings for addition and subtraction.

Tenth Example

In the present tenth example, the toner replenishment amount corresponding to the non-converted portion from the image information to the toner replenishment amount fluctuation pattern and the toner replenishment amount corresponding to the unused portion of the drive control pattern are stored in the nonvolatile memory 103 during the power-off period, and the toner replenishment amount corresponding to the stored non-converted portion and the toner replenishment amount corresponding to the unused portion are respectively reflected to the toner replenishment amount fluctuation pattern and the drive control pattern during the power-on period.

Figure 35:
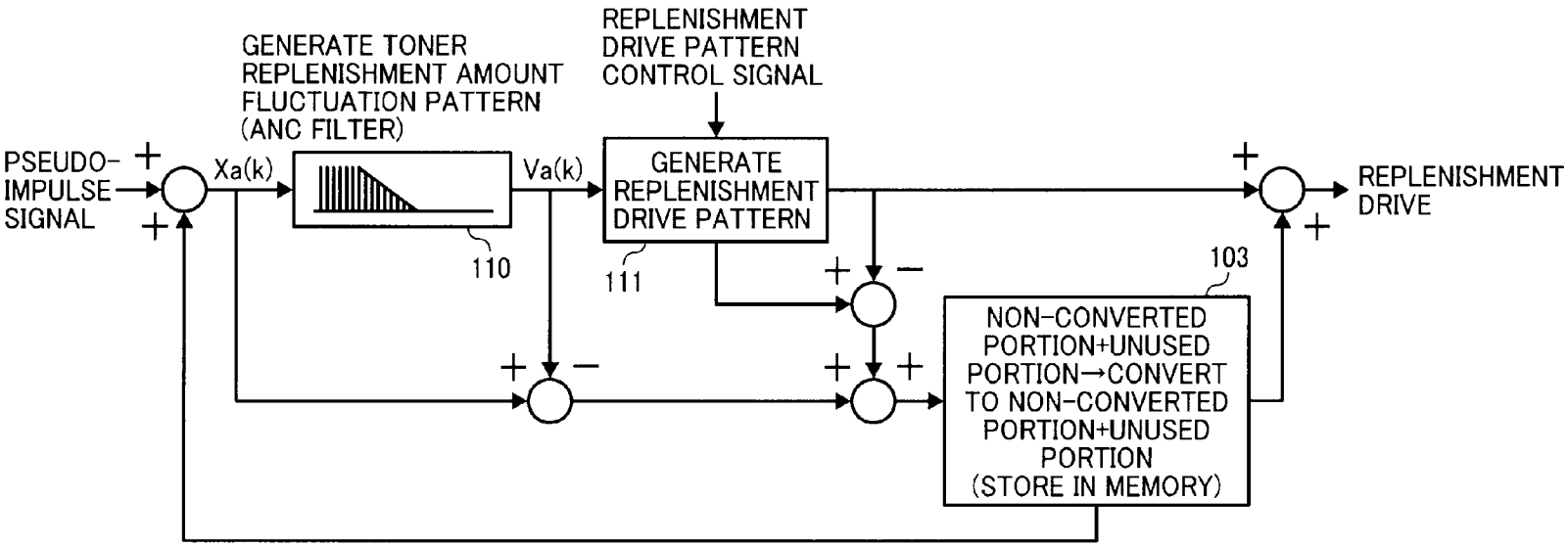
FIG. 35 is a block diagram illustrating part of the circuit configuration of the controller 100 when an unused portion and/or a non-converted portion are stored separately in the nonvolatile memory 103.

FIG. 35 is a block diagram illustrating part of the circuit configuration of the controller 100 when an unused portion and/or a non-converted portion are stored separately in the nonvolatile memory 103. A pseudo-impulse signal corresponding to the image coverage ratio based on the image information is stored in the ANC filter 110. This pseudo-impulse signal is added with the non-converted portion (which will be described later) retrieved from the nonvolatile memory 103 during the power-on period. Then, a difference value between the pseudo-impulse signal being an input to the ANC filter and an output from the ANC filter 110, that is, a non-converted portion of the toner replenishment amount fluctuation pattern, is calculated and is stored in the nonvolatile memory 103.

It is noted that the content stored in the nonvolatile memory 103 may only be read out when the power is turned on or off and can be read out in various ways and timings such as, even when the data is constantly calculated in the nonvolatile memory 113, when the image output has been completed, after the power off command has been received.

The output from the ANC filter 110 is input to the replenishment drive pattern generation circuit 111, thereby forming a drive control pattern. Then, a difference value between the replenishment drive pattern generated based on the input from the ANC filter 110 to the replenishment drive pattern generation circuit 111 and the drive control pattern divided and output from the replenishment drive pattern generation circuit 111, that is, an used portion of the drive control pattern, is calculated and is stored in the nonvolatile memory 103.

It is noted that the content stored in the nonvolatile memory 103 may only be read out when the power is turned on or off and can be read out in various ways and timings such as, even when the data is constantly calculated in the nonvolatile memory 113, when the image output has been completed, after the power off command has been received.

The difference value between the input to and the output from the ANC filter 110 or the non-converted portion of the toner replenishment amount fluctuation pattern, and the difference value between the input to and the output from the replenishment drive pattern generation circuit 111 or the unused portion of the drive control pattern are added. After the addition, data to be reflected to the toner replenishment fluctuation pattern, data to be reflected to the drive control pattern, and data to be reflected to both the toner replenishment fluctuation pattern and the drive control pattern are separately stored in the nonvolatile memory 103. (Specifically, data are separately stored as a non-converted portion or an unused portion, or as a non-converted portion plus an unused portion.)

When calculating variables to store in the nonvolatile memory 103, the ANC filter input and output difference value (that is, the non-converted portion of the toner replenishment amount fluctuation pattern) may be applied directly to data to be reflected to the toner replenishment amount fluctuation pattern, and the replenishment drive pattern generation circuit input and output difference value (that is, the unused portion of the drive control pattern) may be applied directly to data to be reflected to the drive control pattern. Alternatively, after having added the ANC filter input and output difference value (that is, the non-converted portion of the toner replenishment amount fluctuation pattern) and the replenishment drive pattern generation circuit input and output difference value (that is, the unused portion of the drive control pattern), the added data may be applied to the data to be reflected to the toner replenishment amount fluctuation pattern and to the data to be reflected to the drive control pattern. In addition, because the type of the signal of the ANC filer input and output difference value and that of the replenishment drive pattern input and output difference value may be signal-converted at timings of performing addition operation or storing operation to the nonvolatile memory 103, to thus match with the type of signals of the ANC filter input and output difference value (that is, the non-converted portion of the toner replenishment amount fluctuation pattern) and the replenishment drive pattern generation circuit input and output difference value (that is, the unused portion of the drive control pattern).

It is noted that any content may be stored in the nonvolatile memory 103 as far as it can be read out when the power is turned on or off, and the content can be read out in various ways and timings such that the nonvolatile memory 103 constantly continues calculation operation, even when the image output has been completed, or after the power-off command has been received.

Thereafter, the drive control pattern generated in the drive control pattern generation circuit 111 and the unused portion stored in the nonvolatile memory 103 are subjected to the addition and subtraction operation, thereby driving the replenishment operation. In this case, it is preferred that the addition and subtraction of the drive control pattern generated in the replenishment drive pattern generation circuit 111 and the unused portion be performed by being read out from the nonvolatile memory 103 when the power is turned on. In addition, to simplify, the series of operations are illustrated in FIG. 35 as one block including various timings for addition and subtraction.

In the examples 7 to 10 according to the second embodiment, the contents or values to be stored in the nonvolatile memory 103 are not limited to the type of signals to be used in the post-processing such as the non-converted portion of the toner replenishment amount fluctuation pattern or the unused portion of the drive control pattern.

Additional modifications and variations of the present invention are possible in light of the above teachings. It is therefore to be understood that, within the scope of the appended claims, the invention may be practiced other than as specifically described herein.

What is claimed is:

1. An image forming apparatus comprising:

a latent image carrier to carry a latent image thereon;

an image information obtaining unit to obtain image information;

a latent image forming unit to form a latent image based on the obtained image information;

a developer carrier to carry developer formed of toner and carrier thereon;

a developing device to cause the developer to be carried on the surface of the developer carrier to a developing area in which the developer carrier and the latent image carrier are opposed, and develop the latent image by adhering the toner of the developer onto the latent image carried on the latent image carrier;

a toner replenishing device to replenish toner to the developing device;

a controller to adjust a toner replenishment amount by controlling drive of the toner replenishing device based on the image information; and a nonvolatile memory to store information of an amount of the toner replenishment amount which has not been replenished, wherein when the developing device enters a stopped state, information relating to the amount of the toner replenishment amount which has not been replenished is stored in the nonvolatile memory, and when the developing device resumes a driven state from the stopped state, driving of the toner replenishing device is controlled using the information stored in the nonvolatile memory.

2. The image forming apparatus as claimed in claim 1, further comprising:

an ANC filter to form, based on the image information, a toner replenishment amount fluctuation pattern to offset a forecasted toner concentration fluctuation after the developer has passed through the developer supply area; and a replenishment drive pattern generation circuit to generate a drive control pattern for the toner replenishing device based on the toner replenishment amount fluctuation pattern, wherein the information of an amount of the toner replenishment amount which has not been replenished includes information relating to a non-converted portion from the image information to the toner replenishment amount fluctuation pattern, and wherein the controller is configured to control such that, when the drive of the developing device is interrupted, the non-converted portion from the image information to the toner replenishment fluctuation pattern, if any, is stored in the nonvolatile memory, and the information relating to the non-converted portion is converted to the drive control pattern to be used for the drive control of the toner replenishing device when the drive of the developing device is resumed.

3. The image forming apparatus as claimed in claim 1, further comprising:

an ANC filter to form, based on the image information, a toner replenishment amount fluctuation pattern to offset a forecasted toner concentration fluctuation after the developer has passed through the developer supply area; and a replenishment drive pattern generation circuit to generate a drive control pattern for the toner replenishing device based on the toner replenishment amount fluctuation pattern, wherein the information of an amount of the toner replenishment amount which has not been replenished includes information relating to an unused portion of the drive control pattern excluding the portion already reflected to the drive control of the toner replenishing device, and wherein the controller is configured to control such that, when the drive of the developing device is interrupted, the unused portion, if any, of the drive control pattern excluding the portion already reflected to the drive control of the toner replenishing device is stored in the memory, and the information relating to the unused portion is used for the drive control of the toner replenishing device when the drive of the developing device is resumed.

4. The image forming apparatus as claimed in claim 1, further comprising:

an ANC filter to form, based on the image information, a toner replenishment amount fluctuation pattern to offset a forecasted toner concentration fluctuation after the developer has passed through the developer supply area; and a replenishment drive pattern generation circuit to generate a drive control pattern for the toner replenishing device based on the toner replenishment amount fluctuation pattern, wherein the information of an amount of the toner replenishment amount which has not been replenished includes information relating to a non-converted portion from the image information to the toner replenishment amount fluctuation pattern, and an unused portion of the drive control pattern excluding the portion already reflected to the drive control of the toner replenishing device, and wherein the controller is configured to control such that, when the drive of the developing device is interrupted, the non-converted portion from the image information to the toner replenishment amount fluctuation pattern, and an unused portion of the drive control pattern excluding the portion already reflected to the drive control of the toner replenishing device, if any, are stored in the memory, and the information relating to the non-converted portion is converted to the drive control pattern and used together with the unused portion for the drive control of the toner replenishing device when the drive of the developing device is resumed.

5. The image forming apparatus as claimed in claim 1, further comprising:

an ANC filter to form, based on the image information, a toner replenishment amount fluctuation pattern to offset a forecasted toner concentration fluctuation after the developer has passed through the developer supply area; and a replenishment drive pattern generation circuit to generate a drive control pattern for the toner replenishing device based on the toner replenishment amount fluctuation pattern, wherein the information of an amount of the toner replenishment amount which has not been replenished includes information relating to a non-converted portion from the image information to the toner replenishment amount fluctuation pattern, and an unused portion of the drive control pattern excluding the portion already reflected to the drive control of the toner replenishing device, and wherein the controller is configured to control such that, when the drive of the developing device is interrupted, at least one of the non-converted portion from the image information to the toner replenishment amount fluctuation pattern, and an unused portion of the drive control pattern excluding the portion already reflected to the drive control of the toner replenishing device, if any, is stored in the memory, and a process to generate the toner replenishment amount fluctuation pattern based on the information stored in the memory and a process to use the information stored in the memory for the drive control of the toner replenishing device are performed when the drive of the developing device is resumed.

6. The image forming apparatus as claimed in claim 1, wherein, in a continuous image forming operation for a plurality of pages, the controller sequentially generates a drive control pattern based on the image information for each page and either synthesizes an unused portion of the drive control pattern excluding a portion already reflected to the drive control of the toner replenishing device from a drive control pattern generated based on the image information for a previous page, with a drive control pattern generated based on a following page or, while converting the toner replenishment amount fluctuation pattern generated based on the image information of the previous page into the drive control pattern to be used for the drive control of the toner replenishing device, synthesizes the toner replenishment amount fluctuation pattern generated based on the image information of the following page with the non-converted portion from the toner replenishment amount fluctuation pattern of the previous page which is non-converted to the drive control pattern, converting the synthesized toner replenishment amount fluctuation pattern into the drive control pattern to be used for the drive control of the toner replenishing device.

7. The image forming apparatus as claimed in claim 1, further comprising:

an ANC filter to form, based on the image information, a toner replenishment amount fluctuation pattern to offset a toner concentration fluctuation after the developer has passed through the developer supply area; and a replenishment drive pattern generation circuit to generate a drive control pattern for the toner replenishing device based on the toner replenishment amount fluctuation pattern.

8. The image forming apparatus as claimed in claim 1, wherein:

the developing device, while conveying the developer along its predetermined circulation passage, causes the developer existing in a supply area opposite the developer carrier in the circulation passage to be carried on the moving surface of the developer carrier to a developing area in which the developer carrier and the latent image carrier are opposed, with the toner of the developer adhered to the latent image on the latent image carrier, to thus develop the latent image into a visual image, and returns the developer used for development in the developing area to the supply area in the circulation passage in accordance with the moving surface of the developer carrier; and the toner replenishing device replenishes toner to a non-supply area in the circulation passage different from the supply area in the circulation passage through a toner replenishing port disposed at a predetermined position in the non-supply area.

9. The image forming apparatus as claimed in claim 8, further comprising:

an ANC filter to form, based on the image information, a toner replenishment amount fluctuation pattern to offset a toner concentration fluctuation after the developer has passed through the developer supply area; and a replenishment drive pattern generation circuit to generate a drive control pattern for the toner replenishing device based on the toner replenishment amount fluctuation pattern.

10. The image forming apparatus as claimed in claim 1, further comprising:

an ANC filter to form, based on the image information, a toner replenishment amount fluctuation pattern to offset a toner concentration fluctuation after the developer has passed through the developer supply area; and a replenishment drive pattern generation circuit to generate a drive control pattern for the toner replenishing device based on the toner replenishment amount fluctuation pattern wherein the information of an amount of the toner replenishment amount which has not been replenished includes information relating to a non-converted portion from the image information to the toner replenishment amount fluctuation pattern, and wherein the controller is configured to control such that, when the drive of the developing device is interrupted, the non-converted portion, if any, from the image information to the toner replenishment amount fluctuation pattern is stored in the memory, and the information relating to the non-converted portion is used to generate the toner replenishment amount fluctuation pattern when the drive of the development device is resumed.

11. The image forming apparatus as claimed in claim 10, wherein the information is stored in the memory when the power is turned off.

12. The image forming apparatus as claimed in claim 10, wherein the information is stored in the memory upon the printing job is completed.

13. The image forming apparatus as claimed in claim 10, wherein, when the drive of the developing device is resumed, the information stored in the memory is used as an input value to a toner replenishment fluctuation pattern which is different from the initially-targeted toner replenishment fluctuation pattern for which the information was first calculated.

14. The image forming apparatus as claimed in claim 13, wherein, when the drive of the developing device is resumed and a linear speed of the developing device is changed, the toner replenishment amount fluctuation pattern or the drive control pattern is cleared and the information stored in the memory is used as an input value to the toner replenishment fluctuation pattern corresponding to the linear speed.

15. The image forming apparatus as claimed in claim 1, further comprising:

an ANC filter to form, based on the image information, a toner replenishment amount fluctuation pattern to offset a forecasted toner concentration fluctuation after the developer has passed through the developer supply area; and a replenishment drive pattern generation circuit to generate a drive control pattern for the toner replenishing device based on the toner replenishment amount fluctuation pattern, wherein the information of an amount of the toner replenishment amount which has not been replenished includes information relating to an unused portion excluding a portion reflected to a drive control of the toner replenishing device from the drive control pattern, and wherein the controller is configured to control such that, when the drive of the developing device is interrupted, the unused portion excluding a portion reflected to the drive control of the toner replenishing device among the drive control pattern, if any, is stored in the memory, and the information relating to the unused portion is used to generate the toner replenishment amount fluctuation pattern when the drive of the development device is resumed.

16. The image forming apparatus as claimed in claim 15, wherein the information is stored in the memory when the power is turned off.

17. The image forming apparatus as claimed in claim 15, wherein the information is stored in the memory upon the printing job is completed.

* * * * *